US005462824A

United States Patent [19]

Kawamoto et al.

[11] Patent Number: 5,462,824

[45] **Date of Patent: * Oct. 31, 1995**

[54] SILVER HALIDE PHOTOGRAPHIC MATERIAL

[75] Inventors: Fumio Kawamoto; Yoshiki Sakaino, both of Kanagawa; Shohei Yoshida, Shizuoka, all of Japan

[73] Assignee: Fuji Photo Film Co., Ltd., Kanagawa, Japan

[ * ] Notice: The portion of the term of this patent subsequent to Nov. 29, 2011, has been disclaimed.

[21] Appl. No.: 160,160

[22] Filed: Dec. 2, 1993

[30] Foreign Application Priority Data

| | | | |
|---|---|---|---|
| Dec. 3, 1992 | [JP] | Japan | 4-349977 |
| Jan. 5, 1993 | [JP] | Japan | 5-015928 |
| Feb. 26, 1993 | [JP] | Japan | 5-038190 |
| Apr. 27, 1993 | [JP] | Japan | 5-122201 |

[51] Int. Cl.[6] ..... G03C 1/795

[52] U.S. Cl. ..... 430/501; 430/496; 430/533; 430/349; 430/930; 430/939

[58] Field of Search ..... 430/495, 496, 430/501, 347, 930, 939, 349, 533; 264/210.5, 210.7; 242/71, 71.1, 348, 348.4

[56] References Cited

U.S. PATENT DOCUMENTS

| | | | |
|---|---|---|---|
| 2,904,841 | 9/1959 | Haugh | 264/40.2 |
| 3,683,060 | 8/1972 | Tanabe et al. | 264/235.8 |
| 3,937,754 | 2/1976 | Shimotsuma et al. | 525/444 |
| 4,141,735 | 2/1979 | Schrader et al. | 430/533 |
| 5,076,977 | 12/1991 | Maier et al. | 264/210.5 |
| 5,368,997 | 11/1994 | Kawamoto | 430/533 |

FOREIGN PATENT DOCUMENTS

| | | | |
|---|---|---|---|
| 0334367 | 9/1989 | European Pat. Off. . | |
| 0355876 | 2/1990 | European Pat. Off. . | |
| 0496346 | 7/1992 | European Pat. Off. | 430/533 |
| 1502315 | 3/1978 | United Kingdom . | |
| WO9214771 | 9/1992 | WIPO . | |

*Primary Examiner*—Charles L. Bowers, Jr.
*Assistant Examiner*—Mark F. Huff
*Attorney, Agent, or Firm*—Sughrue, Mion, Zinn, Macpeak & Seas

[57] ABSTRACT

Disclosed is a silver halide photographic material provided with at least one silver halide emulsion layer on a support and wound in a roll form, wherein the above support is subjected to a heat treatment until a heat amount in an endothermic peak which appears including a glass transition temperature becomes 100 to 1,000 mcal/g, and the support is of biaxially oriented polyester having a loss elastic modulus of 0.01 to 0.1, the glass transition temperature of 50° to 200° C., a Young's modulus of 530 to 2,000 kg/mm$^2$, a breaking elongation of 60 to 200%, and a ratio of the refraction indexes in a film face direction and a thickness direction of 1.10 to 1.22.

19 Claims, No Drawings

SILVER HALIDE PHOTOGRAPHIC MATERIAL

FIELD OF THE INVENTION

The present invention relates to a silver halide photographic material, specifically to a roll-form silver halide photographic material which uses polyester subjected to a heat treatment, which has the physical attributes of a support and which is rolled on a spool with the major diameter of 5 to 11 mm and which is less liable to get into a curling habit and has an excellent punching processability.

BACKGROUND OF THE INVENTION

A fibrous polymer represented by triacetyl cellulose (hereinafter referred to as "TAC") or a polyester polymer such as polyethylene terephthalate (hereinafter referred to as "PET") are generally used as the support for photographic materials.

In general, photographic materials are in the form of sheet film as X-ray film, plate-making film and cut film or roll film as in color or black-and-white negative roll to be mounted in a cartridge having a width of 35 mm or less.

TAC, when used as the support for roll films, exhibits a high transparency and an excellent decurlability after development.

On the other hand, PET films are excellent in mechanical strength and dimensional stability but remain curled when unwound after development. This poor handleability puts restrictions on its application range despite its excellent properties.

In recent years, photographic materials have been used for a variety of applications, for example, the reduction in the size of cameras, the increase in the film delivery speed upon picture taking and the increase in the magnification. This requires a support having a high strength, a good dimensional stability and a small thickness.

Further, the reduction in the size of cameras accompanies a further demand for smaller cartridges.

In order to miniaturize the cartridge, three problems need to be solved.

One of the three problems is to inhibit the reduction in the dynamic strength accompanied by the reduction in the thickness of the film.

The second problem is that a strong curl develops with time during storage, due to the reduction in the size of the spool.

The third problem is a reduction in the processing aptitude, such as the punching property, which occurs due to the decrease in the dynamic strength of the film. In order to improve the dynamic strength, particularly the elastic modulus to further accelerate thinning, it is common to increase the orienting magnification in case of a biaxial oriented film and raise the crystallinity. However, the resulting film is fragile and liable to cleave. In particular, there is a possibility of generating punching dust in the punching process.

In order to reduce the curl of polyester film a method has been known as disclosed in U.S. Pat. No. 4,141,735 and JP-A-51-16358 (The term "JP-A" as used herein means an "unexamined published Japanese patent application").

SUMMARY OF THE INVENTION

Accordingly, the object of the present invention is to provide a silver halide photographic light-sensitive material (hereinafter referred to as a photographic light-sensitive material or a photographic material) which has an excellent dynamic characteristic and which is difficult to get into a curling habit and which is excellent in a punching characteristic and a manufacturing aptitude.

Further, the object of the present invention is to provide a cartridge which enables the tongue end of the film to be readily pulled out even if a core set would be carried out at a high temperature and which does not cause an uneven development of a film and a heel folding and stores a 35 mm film of 42 frames or more for photographing.

This and other objects of the present invention have been achieved with a silver halide photographic material provided with at least one silver halide emulsion layer on a support and wound in a roll form, halide emulsion layer on a support and wound in a roll form, wherein the support is subjected to a heat treatment until a heat amount in an endothermic peak appears, including a glass transition temperature (Tg) from 100 to 1,000 mcal/g, and a biaxially oriented polyester support having a loss elastic modulus (tan $\delta$) of 0.01 to 0.1, Tg of 50° to 200° C., a Young's modulus of 0.530 to 2,000 kg/mm$^2$, a breading elongation of 60 to 200%, and a ratio of refraction indexes of the film width to the film thickness of 1.10 to 1.22.

Further, this and other objects of the present invention have been achieved with a cartridge for a 35 mm camera in which a 35 mm roll-form film is stored, wherein the roll-form film has a polyethylene polyester support having the thickness of 60 to 122 μm and a glass transition point of 50° to 200° C. and is subjected to a heat treatment at the temperature of 40° C. to the glass transition temperature for 0.1 to 1,500 hours before providing a subbing layer or from after providing the subbing layer to before coating an emulsion; and the stored roll-form film has 42 to 100 frames.

DETAILED DESCRIPTION OF THE INVENTION

First of all, the measuring methods used hereafter and the terms related thereto will be explained.

(1) Core set:

To form a curling habit by rolling a film on a spool. Unless otherwise explained, the curling habit is formed by carrying out a heat treatment at 80° C. for 2 hours after rolling the film on a roll core having a diameter of 8 mm.

(2) Core set curl:

The curling habit in a longitudinal direction formed by the core set. The degree of the curling habit is measured according to Test Method A of ANSI/ASC PH1.29-1985 and expressed in terms of 1/R[m] (R is a radius of the curl).

(3) Glass transition temperature (Tg) and endothermic peak including Tg:

There is defined as Tg, the arithmetic mean of the temperature at which a standard line starts deviating from a base line and the temperature at which it comes back to a new base line when a sample 10 mg film is heated with a differential thermal analyzer (DSC) at 20° C./minute in the stream of helium-nitrogen.

When a sample film subjected to a heat treatment at Tg or lower is subjected to a DSC measurement by the above method, the endothermic peak appears in the vicinity of Tg. The two points at which this endothermic peak intersect the base line can be connected by a linear line and the area bounded by this linear line and the endothermic peak are defined as the endothermic quantity in the endothermic peak which includes Tg. The term "the endothermic peak including Tg" described in the present invention means that Tg is located between the above two points in the endothermic peak.

(4) Loss elastic modulus (tan δ):

The loss elastic modulus tan δ in the present invention is the value obtained by dividing a loss elastic modulus E" with a storage elastic modulus E' and is calculated as tan δ=E"/E'. E" and E' are measured with RHEO VIBROUN DDV-11-EA manufactured by Toyo Boardwin Co., Ltd., and a sample with the thickness of 75 μm, the length of 20 mm and the width of 2 mm is used. The measurement conditions are the oscillation frequency of 11 Hz and the dynamic displacement of ±16 mm and tan δ is calculated from E" and E' at 50° C.

(5) Breaking elongation, Young's modulus:

According to JIS-Z1702-1976, a strip specimen with the width of 10 mm and the length of 100 mm was used to measure at the tension speeds of 300 mm/minute in measuring the breaking elongation and 20 mm/minute in measuring the Young's modulus.

(6) Refraction index:

An Abbe's refractometer (1T type manufactured by Atago Co., Ltd.) was used to carry out a measurement at 25° using the D ray of a natrium lamp. The refraction indexes were obtained in a film-making direction (longitudinal direction) (MD), a traversing direction (lateral direction) (TD) and a thickness direction (TH), and [(MD refraction index+TD direction refraction index)/2]/(TH refraction index) was defined as the ratio of the indexes of film width to film thickness.

(7) Crystallinity:

A density gradient tube in which the suitable amounts of carbon tetrachloride and n-hexane are mixed is used to measure a density at 25. The crystallinity is obtained according to 100×(the density of a film sample-the density of non-crystal)/(the density of crystal-the density of non-crystal) (%). A non-crystalline sample was prepared by suddenly cooling in liquid nitrogen a sample obtained by melting at a temperature higher than a melting point for 5 minutes in a nitrogen stream. On the other hand, there was used as a crystalline sample, a sample obtained by subjecting non-crystal sample prepared by the above mentioned process to an isothermal crystallization at a crystallization temperature in DSC until heat generation was not observed.

(8) Birefringence:

The birefringence was obtained according to the following equation:

$$\text{Birefringence}-n_z-\tfrac{1}{2}(n_{MD}+n_{TD})$$

wherein $n_z$, $n_{MD}$ and $n_{TD}$ represent the refraction indexes in a thickness direction, a longitudinal direction in a film face, and a lateral direction in the film face. For the refraction indexes, the values measured with an Abbe's refractometer at 25° C. using the D ray of a natrium lamp was used.

In the present invention, a photographic material can be prepared which satisfies the three objectives, that is, dynamic strength, curling habit, and processing aptitude, by using the biaxially oriented polyester photographic support described below.

1) Endothermic peak which appears including Tg:

The base of the free volume is decreased by such heat treatment (e.g., JP-A-51-163658) and can be quantitatively evaluated with a differential thermal analyzer (DSC). When the base is measured while the temperature is raised from Tg or lower, it rapidly changes from a small free volume to a large free volume at Tg while accompanied by heat absorption. The endothermic peak, which includes the Tg, is detected on the thermogram of DSC.

An endothermic peak of less than 100 mcal/g cannot produce a sufficient decrease in the free volume and makes the curling habit easier to form. Meanwhile, the larger the endothermic amount, the more the free volume decreases and the more the curling habit becomes hard to form, but at the same time, a film is likely to have less tensibility and fragility and a reduced processing aptitude. Accordingly, there is an upper limit to this endothermic amount for enabling the film to function as a photographic support, and 1,000 mcal/g or less produces a functional support. An additional increase in the endothermic amount does not result in an increase in the ability of the photographic support to curl. In other words, an endothermic amount of 1,000 mcal/g or more provides almost the same effect to the curling habit as an endothermic amount of 1,000 mcal/g or less.

Accordingly, the heat treatment should be carried out so that the endothermic amount is from 100 to 1,000 mcal/g, preferably 200 to 500 mcal/g.

2) Breaking elongation:

Too large of a breaking elongation forms "a hair" around the hole while boring the hole which reduces the processing precision. Meanwhile, too little stretching is liable to generate cutting dust, which causes sticking on the film surface. Accordingly, the breaking elongation should be from 60% to 200%, preferably from 80% to 150%.

3) Young's modulus:

For use as a photographic support, a hydrophilic binder layer is successfully provided as a light-sensitive layer. Since this layer has a hygroscopicity, it exhibits a large expansion motion relative to the temperature, and therefore the support is required to have a Young's modulus which can cope with this expansion. If too thin a film is used, this will become a large problem. A TAC support has a low Young's modulus, and therefore it can not be thinned to less than 100 μm. PET can be thinned to 90 μm. A Young's modulus of 530 kg/mm$^2$ or more is required to produce a thinner film. Meanwhile, a Young's Modulus of 2,000 kg/mm$^2$ or more markedly increases the damage to an edge in boring a hole. Accordingly, the Young's modulus of the support is from 530 to 2,000 kg/mm$^2$, preferably from 530 to 670 kg/mm$^2$, and more preferably from 550 to 650 kg/mm$^2$.

4) Refraction index ratio in film width and thickness:

As described above, raising the Young's modulus is required for thinning a film. In the case of a biaxially oriented polyester, the orientation magnification is generally increased. Since this is accompanied with the orientation of a polymer molecule along the width of the film, a refraction index in the film width becomes large while the refraction index in the thickness becomes small. Accordingly, the film having the larger ratio of refraction indexes in width to thickness (face direction/thickness direction) has a larger Young's modulus. This ratio is required to be 1.10 or more. Meanwhile, increasing this ratio too much is liable to form a crack in the film face direction on a bored section when boring a hole. This is because too strongly aligning the molecular orientation accelerates the alignment of the molecules in a layer form in the film which allows peeling between the layers to take place and this generates a crack by the impact of boring a hole. In order to prevent this, the refraction index ratio is required to be 1.22 or less.

Thus, the refraction index ratio in film width to thickness is from 1.10 to 1.22, preferably from 1.14 to 1.20.

5) Crystallinity:

In addition to raising the Young's modulus to thin a film, increasing the crystallinity is also effective. A crystallinity of 0.3 or more is required to obtain a sufficient Young's modulus as described above. Meanwhile, a value of more than 0.5 markedly reduces the life of an edge in boring a hole and in addition increases the fragility of the film and generates dust when boring the hole. Accordingly, the crystallinity should be from 0.3 to 0.5, preferably from 0.3 5 to 0.45.

6) Loss elastic modulus (tan δ):

Tan δ represents the ratio of a viscosity item and an elastic item. The larger this value is, the more the plastic flow is accelerated. That is, a curling habit is easy to form and easy to recover.

While the curling habit is hard to form by the heat treatment described above, the curling habit once formed preferably recovers in a development processing. Tan δ at 50° C. can be used as the standard therefor. A value of 0.01 or less scarcely allows the curling habit to recover in the development processing. Meanwhile, the value of 0.1 or more allows the curling habit to sufficiently recover in development processing, while allowing the curling habit to easily form on the spool. Accordingly, tan δ is from 0.01 to 0.1, preferably from 0.03 to 0.1, in terms of difficulty in forming the curling habit and good recovery in developing.

7) Glass transition temperature (Tg):

The curling habit reduction effect obtained by the heat treatment carried out at the temperature of Tg or lower in the present invention is lost by exposing to the temperature of Tg or higher. This is because exposing a glass condition having a small free volume to the temperature of Tg or higher allows it to go back once again to a rubber condition with a large free volume due to an active micro Brownian motion, and therefore a curling habit becomes once again easy to form.

The higher the Tg, the more preferable, but no polymer film exists which is generally used, which is transparent and which has Tg of more than 200° C.

Accordingly, Tg is from 50° C. to 200° C., preferably from 90° C. to 200° C., and more preferably from 90° C. to 150° C.

It takes at least several hours of subjecting a support, having an endothermic amount in an endothermic peak including Tg, to a heat treatment until it becomes hard to form a curling habit. In the present invention, investigations made in order to achieve a shorter heat treatment processing time with a high productivity have resulted in the discovery of using polyester having the birefringence of −0.3 to −0.1.

In the case where Tg of this polyester is 90° C. or higher, this birefringence is from −0.27 to 0, preferably from −0.27 to −0.12, and more preferably from −0.25 to −0.14. Further, in the case where polyester has Tg of 50° C. to 90° C., the birefringence is from −0.3 to 0, preferably −0.3 to −0.15, and more preferably from −0.29 to −0.17.

The value of the birefringence is one standard for a molecular alignment in a polymer film, and it is considered that the closer to 0 this value is, the more disorderly the alignment of the polymer molecule, while the farther from 0 the value is, the more ordered the molecular alignment becomes. When this birefringence falls within the range of the present invention, a molecular alignment is suitably disordered, that is, a suitable free volume is present, and the relaxation of the free volume by heat treatment can efficiently be carried out. Meanwhile, a birefringence larger than this range (that is, close to 0) increases the free volume and allows the relaxation to easily take place. However, the elastic modulus is lowered because of a weak molecular orientation, and an improvement in dynamic strength, which is one of the objects of the present invention, can not be achieved. On the contrary, the birefringence smaller than the range of the present invention delays a volume relaxation by the heat treatment. It is believed that this is because the volume relaxation is hard to take place through a narrow gap between the oriented molecules since a molecular orientation is already fixed to some extent at a place where it is formed. That is, it can be said that the presence of the birefringence in the range of the present invention is a range in which both the efficiency of the volume relaxation and the dynamic strength can be achieved.

The preferred value of this birefringence is a little different according to the range of Tg in the present invention. That is, a photographic film is put under various environments, for example, under the high temperature of 80° C. to 90° C. in some cases. In case of polyester having Tg of this temperature or lower (for example, polyethylene terephthalate), it becomes necessary to provide a high dynamic strength in advance, anticipating the reduction of the dynamic strength at a high temperature,,in order to secure the dynamic strength. This requires the use of a base having a strong orientation, that is, a weak birefringence value. This results in a smaller birefringence, that is, a stronger orientation, wherein the more preferred birefringence is from −0.3 to −0.15 in case of polyester having Tg of 90° C. or lower, and from −0.27 to −0.12 in case of polyester having Tg of 90° C. or higher.

There exist two processes for achieving the base having such a birefringence. One is a process in which the stretching conditions (a stretching temperature, a stretching magnification, and a stretching speed) are regulated. Usually, a polyester film is stretched at the temperature of (Tg+10° C.) to (Tg+20° C.), and the birefringence of the support stretched at this condition can generally be set between −0.2 and −0.3. Stretching at Tg to (Tg+10° C.) can set the birefringence at the value of −0.3 or less. Meanwhile, stretching at the temperature of (Tg+20° C.) to (Tg+40° C.) can set the birefringence at −0.2 to −0.1. Further, the birefringence becomes −0.1 to 0 at the temperature of Tg+40° C. or higher. With respect to a stretching magnification, in case of polyester, stretching is usually made by 3 to 3.5 times in longitudinal and lateral directions, respectively, in the case where a stretching temperature is Tg+15° C. The birefringence becomes the value of −0.2 to 0.3 at this condition. The increase in the stretching magnification to 3.5 times or more makes the birefringence −0.3 or less, and the stretching magnification of 2 to 3 times can set the birefringence between −0.1 and −0.2. Further, the stretching magnification ranging from 1 to 2 times can set the birefringence at −0.1 to 0. With respect to a stretching speed, in case of polyester, stretching is usually made at the speed of 50% to 200% per second based on an original length, and the birefringence can be set at −0.2 to −0.3 in this range. The birefringence becomes −0.3 or less at the speed of 200% or more per second. Meanwhile, the birefringence becomes −0.1 to −0.2 at the speed of 50%/second to 5%/second. Further, the birefringence becomes 0 to 0.1 at the speed of 5%/second or less.

The birefringence can be controlled by the regulation of the heat relaxation conditions carried out after stretching, in addition to the stretching conditions. Usually, polyester is subjected to the heat relaxation by 20% to 5% at the temperature range of 200° to 250° C. In case of stretching by 3.6×3.6 times, the birefringence is from −0.2 to −0.3 at such the condition. Meanwhile, the relaxation by 20% to 30% allows the birefringence to take the value of −0.2 to −0.1, and further relaxation provides the birefringence of −0.1 to 0. In the case where the relaxation is 5% or less, the birefringence becomes −0.3 or less.

Thus, the birefringence can be controlled as well as using the stretching condition and the heat relaxing condition.

Further, it can be controlled in the combination of these two processes.

The polyester support having such the birefringence is subjected to the heat treatment so that a free volume is relaxed and an endothermic peak including Tg appears.

The loss elastic modulus, Young's modulus, breaking elongation, refraction index ratio, and crystallinity each falling within the ranges of the present invention can be achieved by setting a stretching temperature of (Tg+10° ) to (Tg+40° C.), a stretching magnification at 3 to 4 times, a stretching speed at 5%/second to 200%/second, a heat relaxation at 5 to 30%, and a heat fixation at 3 seconds to 3 minutes.

They are achieved preferably by setting the stretching temperature at (Tg+10° C.) to (Tg+20° C.), the stretching magnification at 3.3 to 3.6 times, the stretching speed at 50%/second to 200%/second, the heat relaxation at 5 to 20%, and the heat fixation at 5 to 30 seconds.

When the stretching temperature and the heat relaxation are each lower than this range, the loss elastic modulus, the Young's modulus and the refraction index ratio are likely to increase, while the breaking elongation is liable to decrease. Meanwhile, when the stretching magnification and the stretching speed are each lower than this range, the loss elastic modulus, the Young's modulus and the refraction index ratio are likely to decrease, while the breaking elongation is liable to increase. When the heat fixing time is lower than this range, the crystallinity and the Young's modulus are likely to decrease.

A curling habit reduction effect, for which the reduction in free volume is attained by heat treatment, can be produced by two processes; one is the process in which a heat treatment is carried out at the temperature of Tg or lower (hereinafter referred to as "the A process heat treatment); and another is the process in which there is a slow and gradual cooling from the temperature of Tg or higher to the temperature of Tg or lower (hereinafter referred to as "the B process heat treatment").

First, the A process heat treatment, is generally carried out at the temperature of 40° C. to Tg, preferably 50° C. to Tg. A temperature of Tg or higher activates the micro-Brownian motion and cannot decrease a free volume. Meanwhile, the temperature lower than 40° C. requires a lengthy period of time, since a segment transfers to the small free volume condition.

The time consumed for this A process heat treatment is generally from 0.1 to 1,500 hours, preferably from 5 to 150 hours, and more preferably from 12 to 50 hours. The time of less than 0.1 hour cannot fully form a stable structure with a small free volume. Meanwhile, the heat treatment for more than 1,500 hours does not produce any additional effect in the formation of the curling habit.

In the case where the A process heat treatment is carried out, first a base is put in a constant temperature bath in a wound roll form for heating. In this process, a lot of time is required in order to heat a base that is rolled by 1,000 m or more from room temperature to a prescribed temperature. The roll of the base can be heated in a short time by heating the base to the prescribed temperature while transporting it on a web (for example, passing through a heat roll or passing through a place where a warm wind is blown) and rolling it immediately thereafter (before it is cooled).

A polyester film is usually used after it is subjected to a biaxial orientation. Such film causes heat shrinkage. Accordingly, the base wound in a roll form has a heat shrinking stress accumulated from outside to inside, and this likely causes irregularities to form on the film. In order to solve such a problem, there can be considered as well a lo process in which the film is transported on a web at a high temperature to subject it to a sufficient heat shrinkage and then wound in a roll form to subject it to a fixed temperature treatment as it is. Such the heat shrinkage is finished within 30 minutes in case of many polyester films, and therefore the treatment can be carried out during a web transportation in a process.

Next, with respect to the B process heat treatment, a temperature is raised to Tg or higher and then gradually cooled down. In particular, a gradual cooling speed begins in a temperature region immediately after Tg. Accordingly, an average cooling speed at a temperature of Tg to (Tg-40° ) is preferably from −20° C./minute to −0.01° C./minute. Cooling at the speed higher than this does not allow a molecule to catch up to the speed at which the molecule transfers to a stable condition with a small free volume and provides a support which has a large free volume and is easy to get into a curling habit. In the case where a gradual cooling speed is slower than this, the molecule can sufficiently be transferred to a stable structure but the effect thereof is saturated and becomes inferior. This heat treatment may be carried out in a dry condition, or steam may be used to plasticize a molecule in a base with a water molecule and accelerate the shift of a structure to a stable state.

In this process, the temperature before cooling may be anything as long as it is Tg or higher. The elastic modulus of a support is markedly lowered at (Tg+130° C.) or higher, and therefore a trouble such as buckling is liable to be generated. Accordingly, the base is preferably slowly cooled from a temperature of (Tg+130° C.) to Tg.

The characteristic of the B process heat 20 treatment resides in that the heat treating time can be shortened as compared with the A process heat treatment. This can be considered as follows. That is, the segments contained in a stretched polymer film are present under various environments (e.g., some segment exists in a molecular chain which is not stretched so much and is present at a place where it is easy to move, and meanwhile, since some segment is present in a stretched molecular chain, it has a slow moving property), and therefore to precisely observe, Tg at which a Brownian motion is started is not present at one point but is present over a range of temperatures. That is, Tg is slightly different by every segment. In the A process heat treatment, the hat treatment is provided at a fixed temperature, and therefore a volume relaxation is made only to the segments which easily cause volume relaxation at the temperature concerned. The volume relaxation smoothly proceeds while a free volume remains large, but the decrease in the free volume is accompanied by the gradual slowing of the segment. Meanwhile, in the B process heat treatment, the heat treatment is carried out at a broad temperature region from a high temperature to a low temperature. This allows the volume relaxation at the temperature concerned to proceed even if the volume relaxation occurs from a high temperature side, and as the speed thereof is lowered, it moves a little to a lower temperature to carry out the volume relaxation. That is, a temperature is shifted in succession before a volume relaxation speed starts lowering, and therefore the volume relaxation can efficiently be carried out. Thus, the slow cooling heat treating process can be used to carry out the heat treatment in a short time as compared with the fixed temperature treating process. However, achieving this process is difficult and requires a fine temperature control, and the treatment in a roll form is liable to generate a temperature difference inside and outside the roll. Accordingly, the heat treatment is better carried out during a web transportation. However, while a heat treating time can be shortened, the time of 30 minutes or more is required, a long heat treating zone is required and problems are present on the installation and running cost. While the fixed temperature heat treatment process described above requires time, if a constant temperature bath is available the installation cost can be controlled to a low level.

Thus, the fixed temperature heat treating process and the slow cooling heat treating processing have merits and defects, respectively. However, the use of the support having the birefringence falling within the range of the present invention is effective to either process and the shortening of the heat treatment is possible. Either process carries out the volume relaxation, and it is apparent that since the present invention is characterized by using a support which is easy to cause the volume relaxation as described above, it is effective to either process.

It has newly been found that raising the temperature to Tg or higher once before the heat treatment and then enforcing are good for efficiently carrying out the heat treatment (hereinafter this is referred to as a pre-heat treatment).

This effect can be considered as follows.

Broadly classifying, a base can be divided roughly into a crystalline part, a non-crystalline part, and an intermediate condition between the non-crystalline and crystalline parts (for example, a restrained non-crystalline condition in the circumference of crystal). The change in the free volume by the heat treatment described above is liable to take place at the non-crystalline part having a relatively large motility. Meanwhile, the motility is decreased in the intermediate condition to such an extent that a molecule is restrained, and it is considered that treatment for a longer time is required in order to form a stable structure with a small free volume. It is considered in the present invention that after melting the intermediate condition before the heat treatment and making it wholly a non-crystalline structure, the heat treatment is carried out to thereby achieve an efficacy.

The preheat treatment is carried out preferably at the temperature of Tg or higher in order to completely break the intermediate condition. Meanwhile, exceeding Tg+130° C. generally increases the fluidity of a base and causes a problem on handling. Accordingly, the heat treatment is carried out preferably at the temperature of Tg to (Tg+130° C.). The temperature of (Tg+10° C.) to a crystallization temperature is more preferred.

Further, the time of 0.1 minute or more is required for a preheat treatment in order to break this intermediate condition. However, the heat treatment carried out for 1,500 hours or more generates the coloring of the base and is not preferred. Accordingly, the preheat treatment is carried out preferably for 0.1 minute to 1,500 hours, more preferably 1 minute to 1 hour.

This preheat treatment is effective in the case of the A process heat treatment and the B process heat treatment each described above.

These preheat treatments, the A process heat treatment and the B process heat treatment, may be carried out during a base transportation, may be carried out by rolling the base while maintaining it at a high temperature and keeping it in that condition, or may be carried out during a heat fixing process through a rolling process in a film forming process. Further, these processes may be enforced in combination.

The heat treatment carried out during a transportation can generally be carried out by the processes which have so far been carried out from the past (hereinafter, this process is referred to as "a transportation heat treatment process"). The heat treatment may be carried out, for example, by blowing a hot wind in a transporting zone, providing an infrared heater and an electrothermal heater, and using a heating roll.

Although the heat treatment during the transportation can be enforced by either the A process heat treatment or the B process heat treatment, the B process heat treatment is preferably used. The B process heat treatment can shorten a heating zone since it can provide an equal curling habit reduction effect for a shorter time as compared with the A process heat treatment.

A base may be rolled while maintaining it at a high temperature to subject it to the A process heat treatment, the B process heat treatment and the preheat treatment (hereinafter this process will be referred to as "a high temperature rolling process"). Since in case of the A process heat treatment, the heat treatment is carried out at the temperature of Tg to 50° C., the base heated to this temperature may be rolled at that temperature to keep it at that temperature. Further, when the above process is combined with the preheat treatment, after rolling at the temperature of Tg to (Tg+130° C.), the temperature of the base is lowered down to the temperature of Tg to 50° C., and then the base may be maintained at a fixed temperature. Accordingly, in the case where the A process heat treatment is carried out by this way, it is preferably wound at the temperature of 50° C. to (Tg+130° C.). Meanwhile, in case of the B process heat treatment, it is preferably wound at the temperature of Tg to (Tg+130° C.) and then may be cooled at a prescribed speed.

The temperature of the base in rolling can be controlled by blowing wind subjected to a temperature adjustment just before a rolling equipment and controlling a temperature with an infrared heater and an electrothermal heater and with a roll in which a fluid of a fixed temperature is flowed.

A temperature after rolling on a roll may be controlled by rolling a heat insulating material on the roll, and it can be controlled by putting in a thermostatic chamber controlled at a prescribed temperature.

Further, these "high temperature rolling process" and "transporting heat treatment process" may be carried out in combination.

Further, the reduction effect of a free volume achieved by such heat treatments can be accelerated by incorporating water into the base.

With respect to the process by which water is incorporated into the base, after water is coated, the heat treatment may be carried out, or after the base is passed through a water bath, the after-heat treatment may be carried out. The most preferred is a process in which steam of a high temperature is blown on the base. Water can be absorbed fastest in the base with this process.

The amount of water thus incorporated is preferably 0.2% to 5%, more preferably from 0.2% to 1%. An amount less than 0.2% cannot fully provide the effect thereof. Meanwhile, trying to incorporate water by more than 5% takes a very long time and in addition, drying is accompanied with the generation of shrinkage to allow a face condition to be liable to deteriorate.

Such the heat treatment can be carried out, for example, after a polyester film formation and can be enforced after a surface treatment process for improving the adhesion of a subbing layer to a support (for example, a UV ray irradiation, a corona discharge treatment, and a glow discharge treatment). Provided that exposure to the temperature of more than Tg, which is accompanied with an active micro Brownian motion, allows the volume relaxation obtained by this heat treatment to return once again to the state at which a free volume is large and a curling habit is easy to form, and therefore the temperature of Tg or higher should not be reached after heat treatment.

A photographic material for which a support subjected to such heat treatment is used is rolled preferably on a spool with the major diameter of 5 to 11 mm. The major diameter of less than 5 mm will generate a pressure fog on a photographic emulsion and therefore the size of the spool can not be reduced more than this. Meanwhile, the spool with the diameter of more than 11 mm will not generate trouble originating in a curling habit even if such heat treatment is not provided and will provide the diameter of a film roll of 18 to 20 mm, which is obtained by rolling a film with a length corresponding to 36 sheets of photographing film on the spool, and to a large extent it is not different from the existing 135 system. Accordingly, the spool preferably has the diameter of 5 to 11 mm.

The thickness of the support of the present invention is preferably from 60 to 112 μm more preferably from 70 to 100 μm. Since the thinner the support is, the more the cartridge can be miniaturized, the thinner support is preferred. However, the support must have a toughness which can cope with a shrinkage stress exerted by an emulsion layer in a low humidity condition.

Tg of a polyester base used as a support is preferably at least 50° C. or higher. As is apparent from the explanation given above, even if the heat treatment of the present invention is carried out to allow the curling habit to be hard to form, exposure to the temperature of Tg or higher will cancel this effect. Over-the-counter sales is a relatively high temperature condition generally encountered by photographic film. The film is often exposed to direct sunlight at this condition, and therefore reaches a temperature up to 50° C. in a summer season. Accordingly, it becomes necessary to have Tg of at least a 50° C. or higher.

Further, it may be a rare case but if film is left in a car in the sunshine in a summer season, the film is exposed to 80° C. to 90° C. Accordingly, the support more preferably has Tg of 90° C. or higher.

Thus, a higher Tg is more preferred but there does not exist at present, polyester which has a general use and a transparency and is capable of a film formation and which has Tg exceeding 200° C.

Accordingly, Tg of the support of the present invention is generally from 50° C. to 200° C., preferably 90° C. to 200° C., more preferably 90° C. to 150° C.

The biaxially oriented polyester is preferably a polyethylene aromatic decarboxylate polyester.

Examples of the polymer film for use in the present invention include biaxially oriented 2,6-polyethylene naphthalate (PEN) and the derivatives thereof, preferably. For example, the following ones can be enumerated:

(1) Homopolymer:

2,6-Polyethylene naphthalate (PEN)

(2) Polymer composite:

The polymer blend of at least one of polycyclohexanedimethanol terephthalate (PCT), polycarbonate (PC), polyarylate (PAr), polyethylene terephthalate (PET), and polybutylene terephthalate (PBT), and PEN. PCT, PC and PAr are preferably added from the viewpoint of raising Tg and making a curling habit hard to form. These are all non-crystalline polymers and the addition thereof results in lowering a Young's modulus. Accordingly, the blend ratio is preferably 30 parts by weight or less in the sum of these polymers based on 100 parts by weight of PEN. Meanwhile, PET and PBT have low Tg and the prices thereof are low compared with that of PEN. They may be blended for the purpose of reducing cost, and 30 parts by weight or less based on 100 parts by weight of PEN are preferably added. This is because the excessive addition thereof lowers Tg to make a curling habit liable to form.

In addition to such the blend, they may be used as the laminate of PEN and these polymers.

(3) Copolymer:

There may be copolymerized 2,6-naphthalenedicarboxylic acid, ethylene glycol, and the ester products thereof as the main raw materials, and in addition thereto, terephthalic acid, isophthalic acid, phthalic acid, phthalic anhydride, succinic acid, glutaric acid, adipic acid, sebacic acid, succinic anhydride, maleic acid, fumaric acid, maleic anhydride, itaconic acid, citraconic anhydride, tetrahydrophthalic anhydride, diphenylene-p,p'-dicarboxylic acid, tetrachlorophthalic anhydride, 3,6-endomethylenetetrahydrophthalic anhydride, 3,6-endomethylenetetrahydrophthalic anhydride, 1,4-cyclohexanedicarboxylic acid,

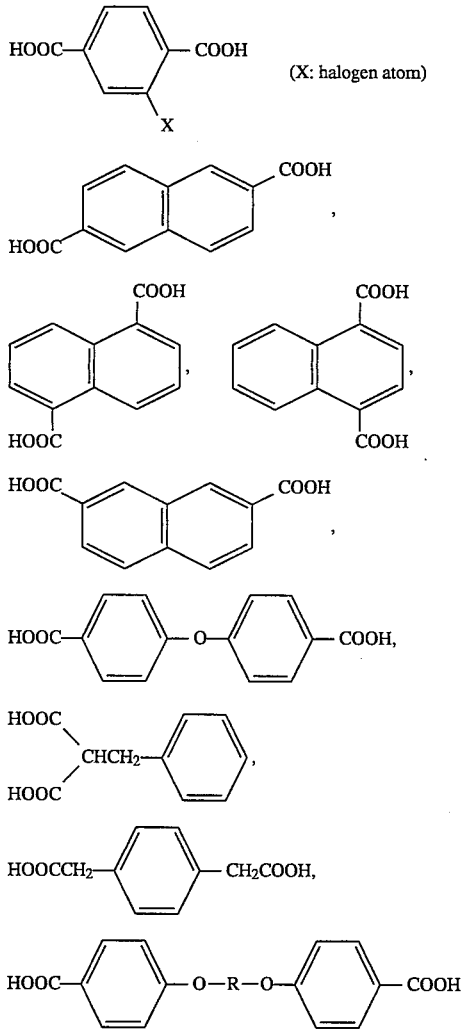

-continued

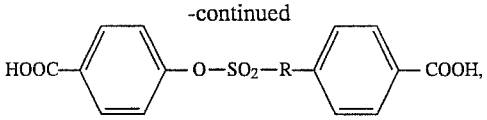

(R: $C_1$ to $C_5$ alkylene group)

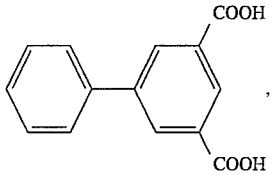

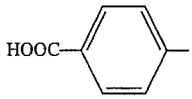

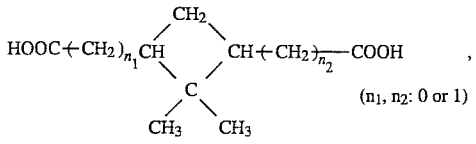

($n_1$, $n_2$: 0 or 1)

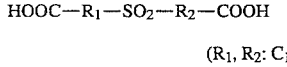

($R_1$, $R_2$: $C_1$ to $C_5$ alkylene group)

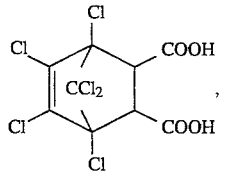

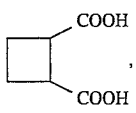

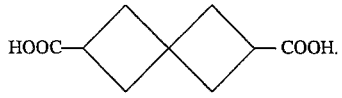

and as diol, ethylene glycol, 1,3-propanediol, 1,2-propanediol, 1,4-butanediol, 1,5-pentanediol, 1,6-hexanediol, 1,7-heptanediol, 1,8-octanediol, 1,10-decanediol, 1,12-dodecanediol, 1,4-cyclohexanediol, 1,4-cyclohexanedimethanol, 1,3-cyclohexanediol, 1,1-cyclohexanedimethanol, catechol, resorcin, hydroquinone, 1,4-benzenedimethanol,

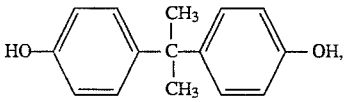

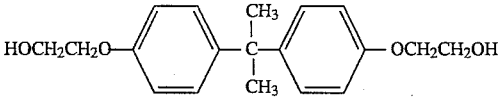

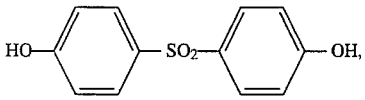

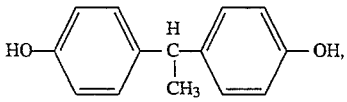

-continued

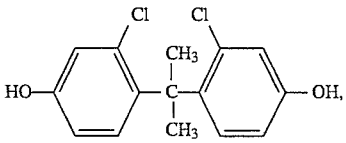

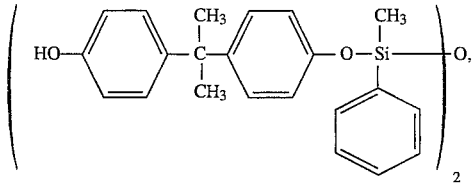

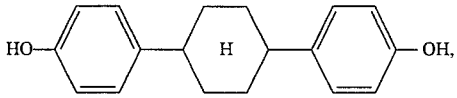

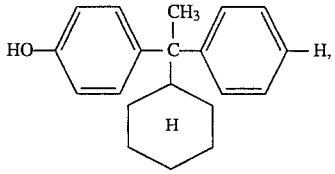

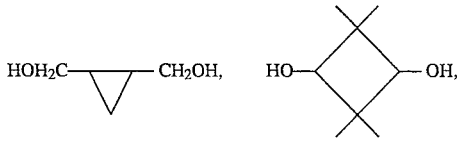

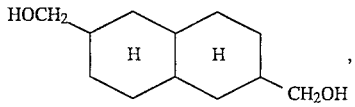

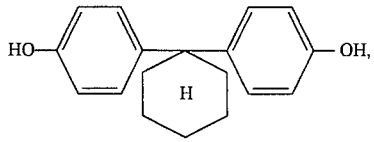

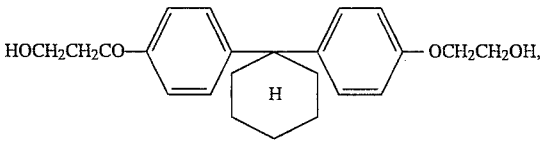

Further, there may be copolymerized according to necessity, a hydroxyl group-containing compound with a single function or polyfunction of 3 or more, or an acid-containing compound.

In addition thereto, there may be copolymerized a compound having a hydroxyl group and a carboxyl group (or ester thereof) in a molecule at the same time.

The following can be enumerated as the example of such the product:

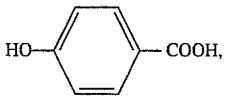

-continued

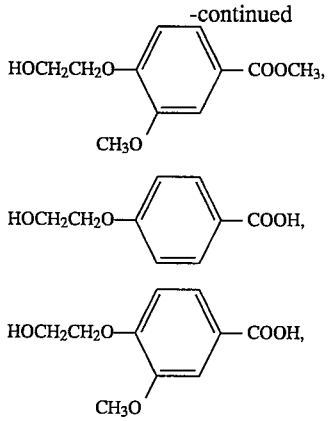

Among the polyesters comprising these diols and dicarboxylic acids, more preferred polyesters include a homopolymer such as polyethylene naphthalate (PEN), polyarylate (PAr), polyethylene terephthalate (PET) and polycyclohexanedimethanol terephthalate (PCT); polyesters obtained by copolymerizing a dicarboxylic acid such as 2,6-naphthalenedicarboxylic acid (NDCA), terephthalic acid (TPA), isophthalic acid (IPA), orthophthalic acid (OPA), cyclohexanedicarboxylic acid (CHDC) and paraphenylenedicarboxylic acid (PPDC), a diol such as ethylene glycol (EG), cyclohexanedimethanol (CHDM), neopentyl glycol (NPG), bisphenol A (BPA) and biphenol (13P), and a hydroxylcarboxylic acid such as parahydroxylbenzoic acid (PHBA) and 6-hydroxy-2-naphthalenecarboxylic acid (HNCA). Of these polyesters, more preferred are the copolymer of benzenedicarboxylic acid, naphthalenedicarboxylic acid and ethylene glycol, the copolymer of 2,6-naphthalenedicarboxylic acid, tererephthalic acid and ethylene glycol (the mixing mole ratio of naphthalenedicarboxylic acid to terephthalic acid is preferably from 0.3:0.7 to 1.0:0, more preferably from 0.5:0.5 to 0.8:0.2), the copolymer of terephthalic acid, ethylene glycol and bisphenol A (the mixing mole ratio of ethylene glycol to bisphenol A is preferably from 0.6:0.4 to 0:1.0, more preferably from 0.5:0.5 to 0.1:0.9), the copolymer of isophthalic acid, paraphenylenedicarboxylic acid, terephthalic acid and ethylene glycol (the mole ratios of isophthalic acid and paraphenylenedicarboxylic acid to terephthalic acid is preferably from 0.1 to 10.0 and from 0.1 to 20.0, more preferably from 0.2 to 5.0 and from 0.2 to 10.0, respectively, based on the assumption that the terephthalic acid is 1), the copolymer of naphthalenedicarboxylic acid, neopentyl glycol and ethylene glycol (the mole ratio of neopentyl glycol to ethylene glycol is preferably from 1:0 to 0.7:0.3, more preferably from 0.9:0.1 to 0.6:0.4), the copolymer of terephthalic acid, ethylene glycol and biphenol (the mole ratio of ethylene glycol to biphenol is preferably from 0:1.0 to 0.8:0.2, more preferably from 0.1:0.9 to 0.7:0.3), and the copolymer of parahydroxylbenzoic acid, ethylene glycol and terephthalic acid (the mole ratio of parahydroxylbenzoic acid to ethylene glycol is preferably from 1:0 to 0.1:0.9, more preferably from 0.9:0.1 to 0.2:0.8); and the polymer blend such as PEN and PET (composition ratio: preferably from 0.3:0.7 to 1.0:0, more preferably from 0.5:0.5 to 0.8:0.2), and PET and PAr (composition ratio: preferably from 0.6:0.4 tO 0:1.0, more preferably from 0.5:0.5 to 0.1:0.9).

Among these polyesters, PEN is the most balanced. It has a high dynamic strength, particularly a high elastic modulus, and the glass transition point is as high as approximately 120° C. However, it has a defect in that it emits a fluorescence. Meanwhile, PCT has a high dynamic strength, and the glass transition point is as high as approximately 110° C. However, it has a defect in that it has a very high crystallization speed and less easily provides a transparent film. Among these polymers, PAr has the highest glass transition point (190° C.). However, it has a defect in that it has a weaker dynamic strength compared to PET. Accordingly, in order to compensate for these defects, a blend of these polymers or the copolymer of the monomers constituting these polymers can be used.

Of these copolymers, preferred are those containing 70% by mole or more of 2,6-naphthalenedicarboxylic acid and ester thereof as a dicarboxylic acid component, and 70% by mole or more of ethylene glycol or the derivative thereof as a diol component. This is because copolymerizing in a higher proportion than this reduces a regularity in a molecule to markedly lower a crystallization degree and makes it difficult to obtain a preferred Young's modulus.

These homopolymers and copolymers can be synthesized according to the known manufacturing methods for polyester. For example, an acid component is subjected directly to an esterification reaction with a glycol component, or in the case where dialkyl ester is used as the acid component, it is first subjected to a transistor with the glycol component and then heated under reduced pressure to remove the surplus glycol component, whereby polyester can be synthesized. Or, the acid component may be converted to acid halide to react with glycol, wherein an ester exchange reaction, a catalyst and a polymerization reaction catalyst may be used and a heat resistant stabilizing agent may be added, if desired. These polyester synthetic. methods can be carried out with reference to the descriptions of, for example, *High Polymer Experiment* Vol. 5 "Condensation Polymerization and Polyaddition", pp. 103 to 136 (Kyoritsu Syuppan Co., Ltd., 1980), and *Synthetic High Polymer V*, pp. 187 to 286 (Asakura Shoten Co., Ltd., 1971).

The average molecular weight of these polyesters is preferably about 10,000 to 500,000.

The polymer blend of the polymers thus obtained can easily be prepared according to the methods described in JP-A-49-5482, JP-A-64-4325, JP-A-3-19278, and Research Disclosures 283,739 to 283,741, 284,779 to 284,782, and 294,807 to 294,814.

Next, the preferred concrete examples of polyester (B) used in the present invention will be shown but the present invention will not be limited thereto.

| | |
|---|---|
| Homopolymer: | |
| PEN: [2,6-naphthalenedicarboxylic acid (NDCA)/ethylene glycol (EG) (100/100)] | Tg = 119° C. |
| PCT: [terephthalic acid (TPA)/cyclohexanedimethanol (CHDM) (100/100)] | Tg = 93° C. |
| PAr: [TPA/bisphenol A (BPA) (100/100)] | Tg = 192° C. |
| Copolymer (the numerals in a parenthesis-represents a mole ratio): | |
| PBC-1: 2,6-NDCA/TPA/EG (50/50/100) | Tg = 92° C. |
| PBC-2: 2,6-NDCA/TPA/EG (75/25/100) | Tg = 102° C. |
| PBC-3: 2,6-NDCA/TPA/EG/BPA (50/50/75/25) | Tg = 112° C. |
| PBC-4: TPA/EG/BPA (100/50/50) | Tg = 105° C. |
| PBC-5: TPA/EG/BPA (100/25/75) | Tg = 135° C. |
| PBC-6: TPA/EG/CHDM/BPA (100/25/25/50) | Tg = 115° C. |
| PBC-7: IPA/PPDC/TPA/EG (20/50/30/100) | Tg = 95° C. |
| PBC-8: NDCA/NPG/EG (100/70/30) | Tg = 105° C. |
| PBC-9: TPA/EG/BP (100/20/80) | Tg = 115° C. |

-continued

| | |
|---|---|
| PBC-10 PHBA/EG/TPA (200/100/100) | Tg = 125° C. |
| Polymer blend (the numerals in a parenthesis represents a weight ratio): | |
| PBB-1: PEN/PET (60/40) | Tg = 95° C. |
| PBB-2: PEN/PET (80/20) | Tg = 104° C. |
| PBB-3: PAR/PEN (50/50) | Tg = 142° C. |
| PBB-4: PAR/PCT (50/50) | Tg = 118° C. |
| PBB-5: PAR/PET (60/40) | Tg = 101° C. |
| PBB-6: PEN/PET/PAR (50/25/25) | Tg = 108° C. |

All of polyesters shown above have stronger bending elastic moduli than TAC and enable thinning of a film, which is an initial object to be achieved. Of them, however, the one having the strongest bending elastic modulus is PEN and the use thereof can decrease a layer thickness requiring 122 μm in TAC down to 60 μm.

These polymer films have the thickness of 50 to 300 μm. A transparent polymer film with the thickness of less than 50 μm having the bending elastic modulus which can stand a shrinking stress in a light-sensitive layer does not yet exist, and that of more than 300 μm does not provide a significance for using a thin spool.

A UV absorber may be mixed in these polymer films for preventing fluorescence and providing an aging stabilizer. Those having no absorptions in a visible wavelength region are desirable as the UV absorber, and the added amount is usually from 0.01 to 20% by weight, preferably from 0.05 to 1.0% by weight, based on the weight of the polymer film. Examples of such UV absorbers, include a benzophenone UV absorber, such as 2,4-dihydroxylbenzophenone, 2-hYdroxyl-4-methoxybenzophenone, 2-hYdroxYl-4-n-octoxybenzophenone, 4-dodecyloxy-2-hydroxylbenzophenone, 2,2',4,4'-tetrahydroxylbenzophenone, 2,2'-dihydroxyl-4,4'-dimethoxybenzophenone; a benzotriazole UV absorber, such as 2(2'-hydroxyl-5-methylphenyl)-benzotriazole, 2(2'-hydroxyl-3',5'-di-t-butylphenyl)-benzotriazole, and 2(2'-hydroxyl-3'-di-t-butyl-5'-methylphenyl)benzotriazole; and a salicylic acid UV absorber, such as phenyl salicylate and methyl salicylate.

The problem of edge fogging which is generated because of the high refraction index of a support is one of the characteristic problems in using a polyester film as a support for photographic material.

Polyester film has a refraction index of 1.6 to 1.7 and gelatin exclusively used for a subbing layer and a photographic emulsion layer has a refraction index of 1.50 to 1.55. The ratio of the refraction index thereof to that of gelatin is smaller than 1 and light incident from a film edge is likely to reflect at the interface between a base and an emulsion layer. Accordingly, the polyester film is likely to cause a light piping phenomenon (edge fogging).

In the present invention, a dye, which does not increase a film phase, can be added in order to prevent the light piping phenomenon. The dye used is not specifically limited. The dye having a color tone of gray is preferred in light of the general character of a photographic material. Further preferred is the dye having an excellent heat resistance at the film forming temperature region of a polyester film and an excellent compatibility with polyester. Diaresin, 10 manufactured by Mitsubishi Kasei Corporation and Kayaset, manufactured by Nippon Kayaku Co., Ltd. are the preferred dyes. Coloring density is generally 0.01 or more, preferably 0.03 or more in terms of a value measured with a densitometer manufactured-by Macbeth Co., Ltd.

The above-mentioned polyester film can be provided with a sliding character according to an application. The means for providing the sliding character is not specifically limited. The mixing of an inactive inorganic compound or the coating of a surface active agent is used as the general means. Further, the method by which an internal particle system in which a catalyst added in a polyester polymerization reaction is deposited can be used.

The examples of the inactive inorganic compounds include $SiO_2$, $TiO_2$, $BaSO_4$, $CaCO_3$, talc, and kaolin. Transparency is an important requisite in the support for a photographic material, and therefore preferred are $SiO_2$ having a refraction index relatively close to that of a polyester film and the internal particle system, which can make the size of the deposited particles relatively small.

After the dye, UV absorber, and sliding agent were kneaded in the above homopolymer, copolymer, and polymer blend according to necessity, and the mixture thereof was sufficiently dried, it was melted at 300° C. and then extruded form a die in the thickness of 900 μm (a laminate is coextruded from a multimanifold die), followed by flowing and spreading on a casting drum and subjecting to a biaxial orientation, a heat fixation and a heat relaxation and then to a film formation. There can be prepared by controlling these conditions, the polyester support having the loss elastic modulus, crystallinity, Young's modulus, breaking elongation, and refraction index ratio each falling within the range of the present invention.

Thus, the support of the present invention can be prepared by controlling the film forming conditions.

The heat treatment of base is preferably performed after the film forming.

The examples of the support are shown in Table 1 but the present invention will not be limited thereto.

TABLE 1

| | Composition | Tg °C. | Endothermic amount mcal/g | tan δ | Crystallinity % | Young's modulus kg/mm$^2$ | Breaking elongation % | Refraction index ratio |
|---|---|---|---|---|---|---|---|---|
| Homopolymer Polymer | PEN | 119 | 320 | 0.020 | 41 | 620 | 130 | 1.15 |
| | Blend | | | | | | | |
| composite (weight ratio) | PEN/PET (90/10) | 115 | 300 | 0.018 | 43 | 590 | 140 | 1.16 |
| | PEN/PC (90/10) | 122 | 270 | 0.025 | 38 | 550 | 150 | 1.14 |
| | PEN/PAR (90/10) | 126 | 280 | 0.027 | 37 | 560 | 160 | 1.14 |
| | PEN/PCT (90/10) | 117 | 260 | 0.030 | 35 | 560 | 150 | 1.13 |
| | Laminate | | | | | | | |
| | PEN/PET (90/10) | 119 | 305 | 0.019 | 43 | 570 | 135 | 1.15 |
| | PEN/PC (90/10) | 119 | 280 | 0.023 | 37 | 580 | 145 | 1.15 |
| | PEN/PAr (90/10) | 119 | 280 | 0.022 | 38 | 560 | 155 | 1.15 |

TABLE 1-continued

| | Composition | Tg °C. | Endothermic amount mcal/g | tan δ | Crystal-linity % | Young's modulus kg/mm² | Breaking elongation % | Refraction index ratio |
|---|---|---|---|---|---|---|---|---|
| | PEN/PCT (90/10) | 119 | 265 | 0.028 | 36 | 550 | 155 | 1.15 |
| Copolymer (mole ratio) | NDCA/EG/BPA (100/90/10) | 123 | 290 | 0.023 | 35 | 570 | 140 | 1.14 |
| | NDCA/EG/CHDM (100/90/10) | 116 | 285 | 9.025 | 36 | 580 | 155 | 1.13 |
| | NDCA/EG/TPA (90/100/10) | 117 | 270 | 0.020 | 39 | 580 | 150 | 1.13 |

Further, in the case where the sliding character is provided by mixing, the method in which a layer provided with a function is laminated is preferred as well in order to obtain more transparency of a film. To be concrete, a co-extruding method by a plurality of the extruders and a feed block or a multi-manifold die can be enumerated as the means therefor.

In the case where these polymer films are used for a photographic support, because any of these polymer films has a hydrophobic surface, it is very difficult to firmly adhere a photographic layer (for example, a light-sensitive silver halide emulsion layer, an intermediate layer, and a filter layer) comprising a protective colloid mainly containing gelatin on the support.

Two processes are available as a conventional technique tried in order to overcome the difficulty:

(1) a process in which after providing a surface activation treatment such as a chemical treatment, a mechanical treatment, a corona discharge treatment, a flame treatment, a UV treatment, a high frequency wave treatment, a glow discharge treatment, an active plasma treatment, a laser treatment, a mixed acid treatment, and an ozone oxidation treatment, a photographic emulsion is coated directly thereon to obtain an adhesive strength, and (2) a process in which a subbing layer is provided after once carrying out these surface treatments or without having the surface treatment, and then a photographic emulsion layer is coated thereon. (For example, U.S. Pat. Nos. 2,698,241, 2,764,520, 2,864,755, 3,462,335, 3,475,193, 3,143,421, 3,501,301, 3,460,944, and 3,674,531, British Patents 788,365, 804,005, and 10 891,469, and JP-B-48-43122 (the term "JP-B" as used herein means an "examined Japanese patent publication") and JP-B-51-446).

It is assumed that any of these surface treatments is effected by forming some polar groups on a support surface which is originally hydrophobic and increasing a cross linking density on a surface, and it is considered that the results thereof lead to the increase in an affinity of the components contained in a subbing solution with the polar group, or the increase in a fastness on an adhered surface. Further, various devices are given to the constitution of a subbing layer; there are available a so-called multilayer process in which a layer adhering well to a support (hereinafter abbreviated to the first subbing layer) is provided as the first layer and a hydrophilic resin layer adhering well to a photographic layer (hereinafter abbreviated to the second subbing layer) is provided thereon as the second layer, and a single layer process in which there is coated only a resin layer containing both a hydrophobic group and a hydrophilic group.

Of the surface treatments described in above (1), the corona discharge treatment is the most known process and can be carried out by any of the conventional processes, for example, the processes disclosed in JP-B-48-5034, JP-B-47-51905, JP-A-47-28067, JP-A-49-83767, JP-A-51-41770, and JP-A-51-131576. A discharge frequency is generally 50 to 5,000 kHz, preferably 5 to 100 kHz. The too small discharge frequency does not provide a stable discharge and unfavorably generates a pin hole on a material to be treated. On the contrary, the too high frequency requires a specific equipment for an impedance matching and unfavorably increases the cost of the machine. The treatment strength of the substance to be treated is preferably 0.001 to 5 kV.A.minute/m², more preferably 0.01 to 1 kV.A.minute/m² for the improvement in a wetting character of a plastic film of conventional polyester and polyolefin. A gap clearance between an electrode and a dielectric roll is generally 0.5 to 2.5 mm, preferably from 1.0 to 2.0 mm.

In many case, there can be used for the glow discharge treatment which is the most effective surface treatment, the processes disclosed in, for example, JP-B-35-7578, JP-B-36-10336, JP-B-45-22004, JP-B-45-22005, JP-B-45-24040, JP-B-46-43480, U.S. Pat. Nos. 3,057,792, 3,057,795, 3,179,482, 3,288,638, 3,309,299, 424,735, 3,462,335, 3,475,307 and 3,761,299, British Patent 997,093, and JP-A-53-129262.

With respect to the glow discharge treatment conditions, in general, a pressure is preferably 0.005 to 20 Torr, more preferably 0.02 to 2 Torr. Too low of a pressure reduces the surface treatment effect and too high of a pressure allows an excessive current to flow which is liable to generate a spark. It is dangerous and provides the possibility to break the substance to be treated. Discharge is generated by loading a high voltage between the metal plates or metal rods disposed at the interval of one pair or more in a vacuum tank. This voltage can have various values according to a composition and pressure of an environmental gas. Usually, a stable and steady glow discharge takes place between 500 to 5,000 V in the above pressure range. The voltage range particularly suitable for improving an adhesion is 2,000 to 4,000 V.

A discharge frequency is preferably a direct current of some 1000 MHz, an alternating current of 50 Hz to 20 MHz as can be seen in a conventional technique. A discharge treatment strength is preferably 0.01 to 5 kV.A.minute/m² 1 more preferably 0.15 to 1 kV.A.minute/m² since a desired adhesive performance can be obtained.

Next, the surface treatment in (2) will be described. Any of these processes is investigated well. There have been examined the characteristics of many polymers such as polyethyleneimine, an epoxy resin, grafted gelatin, and nitrocellulose as well as the copolymers the starting materials of which are the monomers selected from vinyl chloride, vinylidene chloride, butadiene, methacrylic acid, acrylic acid, itaconic acid, and maleic anhydride for the first subbing layer, and mainly of gelatin for the second subbing layer in the multilayer process.

In the single layer process, a support is swollen and is subjected to an interfacial mixing with a hydrophilic subbing polymer to achieve a good adhesion in many cases.

There can be enumerated as the hydrophilic subbing polymer used in the present invention, a water soluble polymer, cellulose ester, a latex polymer, and a water soluble polyester. The examples of the hydrophilic binders used in the present invention include a water soluble ,polymer, such as gelatin, gelatin derivatives, casein, agar, sodium alginate, starch, polyvinyl alcohol, a polyacrylic acid copolymer, and a maleic anhydride copolymer; cellulose ester, such as carboxymethyl cellulose and hydroxylethyl cellulose; and a latex polymer, such as a vinyl chloride-containing copopolymer, a vinyldiene chloride-containing copolymer, an acrylic acid ester-containing copolymer, a vinyl acetate-containing copolymer, and a butadiene,containing copolymer. Of them, more preferred is gelatin.

The examples of the compound which swell the support used in the present invention include resorcin, chlororesorcin, methylresorcin, o-cresol, m-cresol, p-cresol, phenol, o-chlorophenol, p-chlorophenol, dichlorophenol, trichlorophenol, monochloroacetic acid, dichloroacetic acid, trifluoroacetic acid, and chloral hydrate. Of them, preferred are resorcin and p-chlorophenol.

Various gelatin hardeners can be used for the subbing layer according to the present invention.

The examples of the gelatin hardeners include a chromium salt (e.g., chrome alum), aldehydes (e.g., formaldehyde, glutaraldehyde), isocyanates, an active halogen compound (e.g., 2,4-dichloro-6-hydroxyl-s-triazine), and an epichlorohydrin resin.

An inorganic fine particle such as $SiO_2$ and $TiO_2$ or a polymethyl methacrylate copolymer fine particle (diameter: 1 to 10 μm) can be incorporated into the subbing layer according to the present invention as a matting agent.

In addition thereto, various additives can be incorporated into a subbing solution, if desired. They are, for example, a surface active agent, an antistatic agent, an antihalation agent, a coloring dye, a pigment, a coating aid, and an antifogging agent. In the case where the subbing solution for the first subbing layer is used in the present invention, an etching agent such as resorcin, chloral hydrate, and chlorophenol is not required at all to be incorporated into the subbing solution. However, the above etching agents may be incorporated into the subbing solution by request.

The subbing solution according to the present invention can be coated by the coating processes generally well known, for example, a dip coating process, an air knife coating process, a curtain coating process, a roller coating process, a wire bar coating process, a gravure coating process, or an extrusion coating process in which a hopper described in U.S. Pat. No. 2,681,294 is used. Two or more layers can simultaneously be coated according to the processes described in U.S. Pat. Nos. 2,761,791, 3,508,947, 2,941,898, and. 3,526,528, and *Coating Technology* written by Y. Harasaki, p. 253 (published by Asakura Book, 1973), if desired.

There may be applied as a binder for the backing layer, a hydrophobic polymer or a hydrophilic polymer as that used for the subbing layer.

An antistatic agent, a sliding agent, a matting agent, a surface active agent, and a dye can be incorporated into the backing layer of the photographic material according to the present invention. The antistatic agent used in the backing layer according to the present invention is not specifically limited. Examples of anionic high polymer electrolytes include a high polymer containing a carboxylic acid, a carboxylic acid salt and a sulfonic acid salt, for example, the high polymers described in JP-A-48-22017, JP-B-46-24159, JP-A-51-30725, JP-A-51-129216, and JP-A-55-95942. Examples of cationic high polymers include those described in JP-A-49-121523, JP-A-48-91165, and JP-B-49-24582. Further, examples of ionic surface active agents include as well an anionic one and a cationic one, and these can be the compounds described in JP-A-49-85826, JP-A-49-33630, U.S. Pat. Nos. 2,992,108 and 3,206,312, JP-A-48-87826, JP-B-49-11567, JP-B-49-11568, and JP-A-55-70837.

More preferred as the antistatic agent for the backing layer of the present invention is the fine particle of at least one crystalline metal oxide selected form ZnO, $TiO_2$, $SnO_2$, $Al_2O_3$, $In_2O_3$, $SiO_2$, MgO, BaO, and $MoO_2$, or the composite oxide thereof.

The fine particle of the conductive crystalline oxide or the composite oxide thereof used in the present invention has a volume resistivity of $10^7$ Ωcm or less, more preferably $10^5$ Ωcm or less. The particle size thereof is preferably 0.01 to 0.7 μm, more preferably 0.02 to 0.5 μm.

The manufacturing methods for the fine particle of the conductive crystalline oxide or the composite oxide thereof used in the present invention are described in JP-A-56-143430 and JP-A-60-258541. Easily applied are, first, the method in which a metal oxide fine particle is formed by calcination and subjected to heat treatment under the presence of a dissimilar atom which improves conductivity. Second, the method in which the dissimilar atom for improving conductivity is allowed to coexist when the metal oxide fine particle is manufactured by calcination. Third, the method in which when the metal oxide fine particle is manufactured by calcination, the oxygen concentration in the atmosphere is reduced to introduce an oxygen deficiency. Preferred examples in which the dissimilar atom is contained include Al and In to ZnO; Nb and Ta to $TiO_2$; and Sb, Nb and a halogen atom to $SnO_2$. The addition amount of the dissimilar atom is preferably from 0.01 to 30 mol %, more preferably from 0.1 to 10 mol %.

The film of the present invention has preferably at least one layer selected from a layer comprising a conductive oxide, a layer comprising a sliding agent, and a layer comprising a matting agent.

Next, the photographic layers in the photographic material of the present invention will be described.

A silver halide emulsion layer may be either for black and white or for color. A silver halide color photographic material will be explained here.

The light-sensitive material of the present invention may be provided on a support with at least one of the silver halide emulsion layers comprising a blue-sensitive layer, a green-sensitive layer and a red-sensitive layer, and there are specifically no limits to the number and order of the silver halide emulsion layers and non-light-sensitive layers. One typical example is the silver halide photographic light-sensitive material having on a support at least one light-sensitive layer comprising a plurality of the silver halide emulsion layers having substantially the same spectral sensitivity but different light sensitivities, wherein the light-sensitive layer is a unit light-sensitive layer having the spectral sensitivity to any of blue light, green light and red light. In a multi-layer silver halide color photographic light-sensitive material, the unit light-sensitive layer is usually provided in the order of a red-sensitive layer, a green-sensitive layer and a blue-sensitive layer from the support side. According to purposes, however, the above order may be changed, or there can be a layer having a different light sensitivity interposed between the layers having the same spectral sensitivity.

Various non-light-sensitive layers such as an intermediate layer may be provided between the above silver halide light-sensitive layers and on the uppermost layer or lowest layer.

The above intermediate layer may contain the couplers and DIR compounds described in JP-A-61-43748, JP-A-59-113438, JP-A-59-113440, JP-A-61-20037, and JP-A-61-20038 and may further contain an anti-color mixing agent as usually used.

A plurality of the silver halide emulsion layers constituting the respective unit light-sensitive layers are described in German Patent 1,121,470, British Patent 923,045, JP-A-57-112751 , JP-A-62-200350, JP-A-62-206541, JP-A-62-206543, JP-A-56-25738, JP-A-62-63936, JP-A-59-202464 , JP-B-55-34932 and JP-B-49-15495.

The silver halide grains may be those having a regular crystal such as cube, octahedron and tetra-decahedron, those having an irregular crystal such as sphere and plate, those having a defective crystal such as a twinned crystal, or the composite form thereof.

A silver halide may comprise the fine grains having the size of about 0.2 μm or less, or the large grains having the projected area-circle corresponding diameter of up to about 10 μm. The silver halide emulsion may be either polydispersed or monodispersed.

The silver halide photographic emulsion which can be used in the present invention can be prepared by the methods described in, for example, Research Disclosure (RD) No. 17643 (December 1978), pp. 22 to 23, "I Emulsion Preparation and Types" and RD No. 18716 (November 1979), pp. 648, *Chimie et Physique Photographigue* written by P. Glafkides, published by Paul Montel Co. (1967), *Photographic Emulsion Chemistry* written by G. F. Duffin, published by Focal Press Co. (1966), and *Making and coating photographic Emulsion* written by V. L. Zelikman et al, published by Focal Press Co. (1964).

Preferred as well are the monodispersed emulsions described in U.S. Pat. Nos. 3,574,628 and 3,655,394, and British Patent 1,413,748.

Tabular grains having an aspect ratio of about 5 or more can be used as well in the present invention. The tabular grains can readily be prepared according to the processes described in *Photographic Science and Engineering* written by Gutoff, vol. 14, pp. 248 to 257 (1970), U.S. Pat. Nos. 4,434,226, 4,414,310, 4,433,048, and 4,439,520, and British Patent 2,112,157.

The crystal structure may be uniform or of a structure in which a halogen composition is different in an inside and a surface, or of a stratum structure. Further, silver halides of different compositions may be conjugated with an epitaxial conjunction. Also, it may be of a structure in which silver halide is conjugated with compounds other than silver halide, for example, silver rhodanide and lead oxide. Further, a mixture of the grains having different crystal forms may be used.

Usually, the silver halide emulsions are subjected to a physical ripening, a chemical ripening and a spectral sensitization before using. The effects of the present invention are observed particularly notably when an emulsion sensitized with a gold compound and a sulfur-containing compound is used. The additives used in such processes are described in Resbarch Disclosures, No. 17643 and No. 18716, and the corresponding portions are summarized in the table shown later.

The publicly known photographic additives which can be used in the present invention are described as well in the above three Research Disclosures, and the corresponding portions described therein are shown in the following table.

| Kind of additives | RD 17643 | RD 18716 |
|---|---|---|
| Chemical sensitizer | — | p. 648, right column |
| Sensitivity improver | — | p. 648, right column |
| pectral sensitizer, Supersensitizer | pp. 23 to 24 | p. 648, right column to p. 649, right column |
| Whitening agent | p. 24 | — |
| Antifoggant stabilizer | pp. 24 to 25 | p. 649, right column |
| Light absorber, Filter dye, UV absorber | pp. 25 to 26 | p. 649, right column to p. 650, left column |
| Anti-stain agent | p. 25, right column | p. 650, left column to right column |
| Dye image stabilizer | p. 25 | — |
| Hardener | p. 26 | p. 651, left column |
| Binder | p. 26 | p. 651, left column |
| Plasticizer, Lubricant | p. 27 | p. 650, right column |
| Coating aid, Surfactant | pp. 26 to 27 | p. 650, right column |

For the purpose of preventing the deterioration of the photographic performances attributable to a formaldehyde gas, preferably added to a light-sensitive material are the compounds capable of reacting with formaldehyde to fix it, which are described in U.S. Pat. Nos. 4,411,987 and 4,435,503.

Various color couplers can be used for the present invention and concrete examples thereof are described in the patents abstracted in above Research Disclosure (RD) No. 17643, VII-C to G.

Preferred as a yellow coupler are the compounds described in, for example, U.S. Pat. Nos. 3,933,501, 4,022,620, 4,326,024, 4,401,752 and 4,248,961, JP-B-58-10739, British Patents 1,425,020 and 1,476,760, U.S. Pat. Nos. 3,973,968, 4,314,023, and 4,511,649, and European Patent 249,473A.

The 5-pyrazolone and pyrazoloazole compounds are preferred as a magenta coupler. Particularly preferred are the compounds described in U.S. Pat. Nos. 4,310,619 and 4,351,897, European Patent 73,636, U.S. Pat. Nos. 3,061,432 and 3,725,067, Research Disclosure No. 24220 (June 1984), JP-A-60-33552, Research Disclosure No. 24230 (June 1984), JP-A-60-43659, 61-72238, 60-35730, 55-118034, and 60-185951, U.S. Pat. Nos. 4,500,630, 4,540,654 and 4,556,630, and WO (PCT) 88/04795.

There can be enumerated as a cyan coupler, the phenol and naphthol couplers. Preferred are the compounds described in, for example, U.S. Pat. Nos. 4,052,212, 4,146,396, 4,228,233, 4,296,200, 2,369,929, 2,801,171, 2,772,162, 2,895,826, 3,772,002, 3,758,308, 4,334,011, and 4,327,173, German Patent Publication 3,329,729, European Patents 121,365A and 249,453A, U.S. Pat. Nos. 3,446,622, 4,333,999, 4,753,871, 4,451,559, 4,427,767, 4,690,889, 4,254,212, and 4,296,199, and JP-A-61-42658.

Preferred as a colored coupler used for correcting any unnecessary absorption of a developed dye are the compounds described in Research Disclosure No. 17643, Item VII-G, U.S. Pat. No. 4,163,670, JP-B-57-39413, U.S. Pat. Nos. 4,004,929 and 4,138,258, and British Patent 1,146,368.

Preferred as a coupler capable of forming a developed dye having an appropriate dispersing property are the compounds described in U.S. Pat. No. 4,366,237, British Patent 2,125,570, European Patent 96,570, and German Patent (published) 3,234,533.

The typical examples of a dye-forming polymerized coupler are described in U.S. Patents 3,451,820, 4,080,211, 4,367,282, 4,409,320 and 4,576,91.0, and British Patent 2,102,137.

There can be preferably used as well in the present invention, a coupler releasing a photographically useful residue upon coupling. Preferred as DIR coupler releasing a development inhibitor are the compounds described in the patents abstracted in above RD 17643, Item VII-F, JP-A-57-151944, JP-A-57-154234, JP-A-60-184248, JP-A-63-37346, and U.S. Pat. No. 4,248,962.

Preferred as a coupler releasing imagewise a nucleus-forming agent or a development accelerator in developing are those described in British Patents 2,097,140 and 2,131,188, and JP-A-59-157638 and JP-A-59-170840.

In addition to the above compounds, there can be enumerated as the couplers capable of being used for the light-sensitive material according to the present invention, the competitive Couplers described in U.S. Pat. No. 4,130,427; the polyequivalent couplers described in U.S. Pat. Nos. 4,283,472, 4,338,393 and 4,310,618; the DIR redox compound-releasing couplers, the DIR coupler-releasing couplers, the DIR coupler-releasing redox compounds, or the DIR redox-releasing redox compounds each described in JP-A-60-185950 and JP-A-62-24252; and the couplers releasing a dye the color of which is recovered after releasing, described in European Patent 173,302A; the bleaching accelerator-releasing couplers described in RD No. 11449 and No. 24241, and JP-A-61-201247; the compounds releasing a ligand, described in U.S. Pat. No. 4,553,477; and the couplers releasing a leuco dye, described in JP-A-63-75747.

The couplers used in the present invention can be introduced into a light-sensitive material by various conventional dispersing methods.

The examples of a high boiling-solvent used in an oil-in-water dispersion process are described in U.S. Pat. No. 2,322,027.

There can be enumerated as the concrete examples of the high boiling organic solvent which is used in the oil-in-water dispersion process and has the boiling point of 175° C. or higher at a normal pressure, phthalic acid esters, esters of phosphoric acid or sulfonic acid, benzoic acid esters, amides, alcohols or phenols, aliphatic carboxylic acid esters, aniline derivatives, and hydrocarbons. Further, there can be used as an auxiliary solvent, organic solvents having a boiling point of about 30° C. or higher, preferably from 50° C. to 160° C. There can be enumerated as the typical examples thereof, ethyl acetate, butyl acetate, ethyl propionate, methyl ethyl ketone, cyclohexanone, 2-ethoxyethyl acetate, and dimethylformamide.

The concrete examples of the processes and effects in a latex dispersing process and the latexes for impregnation are described in U.S. Pat. No. 25 4,199,363, and German Patent Applications (OLS) Nos. 2,541,274 and 2,541,230.

In the light-sensitive material of the present invention, the sum of the thicknesses of all the hydrophilic colloid layers provided on a support side having thereon an emulsion layer is preferably 28 μm or less and a layer swelling speed $T^{1/2}$ is preferably 30 seconds or less. The layer thickness means a thickness measured at 25° C. under the adjustment of a humidity to the relative humidity of 55% (2 days). The layer swelling speed $T^{1/2}$ can be measured according to the method publicly known in the art. It can be measured, for example, with the swellometer of the type described in *Photographic Science and Engineering* written by A. Green et al, vol. 19, No. 2, pp. 124 to 129. $T^{1/2}$ is defined by the time necessary to reach a half of a saturated layer thickness, in which the saturated layer thickness corresponds to 90% of the maximum swelling layer thickness attained when the layer is processed in a color developing solution at 30° C. for 3 minutes and 15 seconds.

The layer swelling speed $T^{1/2}$ can be controlled by adding a hardener to gelatin which acts as a binder or by changing the aging conditions after coating. A swelling ratio is preferably 150 to 400%, wherein the swelling ratio can be calculated from the maximum swollen layer thickness attained at the above mentioned conditions according to the following equation:

(maximum swollen layer thickness−layer thickness)÷layer thickness.

The photographic material according to the present invention can be subjected to a development processing according to the conventional processes described in above RD No. 17643, pp. 28 to 29, and No. 18716, a left column to a right column at p. 615.

A color developing agent may be incorporated into the silver halide color light-sensitive material according to the present invention for the purposes of simplification and acceleration of the processing. Various precursors of the developing agents are preferably used for the incorporation thereof. There can be enumerated, for example, the indoaniline type compounds described in U.S. Pat. No. 3,342,597, and the Schiff base type compounds described in U.S. Pat. No. 3,342,599, and Research Disclosure Nos. 14,850 and 15,159.

The present invention will further be explained with reference to the examples but the present invention will not be limited thereto. The "parts" as used herein indicates "parts by weight" unless otherwise specified.

EXAMPLES

Example 1-1

1) Preparation of the support:

The following supports $A_1$ to $C_1$, were prepared according to the processes described below:

Support $A_1$ (polyethylene naphthalate (PEN): thickness 50 μm, 60 μm and 85 μm), Support B, (polyethylene terephthalate (PET); thickness 90 μm), Support C, (triacetyl cellulose (TAC): thickness 122 μm and 110 μm).

Support $A_1$

Diaresin (manufactured by Mitsubishi Kasei Corporation) as a dye was mixed in a commercially available polyethylene-2,6-naphthalate polymer 100 weight by parts so that an absorbance in the thickness of 80 μm becomes 0.05 in 400 nm, and the polymer was dried in an ordinary manner. The polymer was melted at 300° C. and then extruded from a T type die. It was subjected to a longitudinal orientation of 3.3 times at 140° C. and subsequently to a lateral orientation of 3.3 times at 130° C., followed by heat fixation at 250° C. for 6 seconds, whereby the films with the thicknesses of 50 μm, 60 μm, and 85 μm were obtained. Support $B_1$ A commercially available polyethylene terephthalate polymer was subjected to a biaxial orientation and a heat fixation according to the conventional processes to thereby obtain a film with the thickness of 90 μm.

Support $C_1$

Triacetyl cellulose was dissolved in methylene chloride/methanol=8/2 ratio by weight in the TAC concentration of 13% using the plasticizers TPP/BDP=2/1 (wherein TPP: triphenyl phosphate and BDP: biphenyl diphenyl phosphate), and the solution was processed by a conventional solution flowing process to thereby prepare the supports with the thicknesses of 122 μm and 110 μm by the band process of 15% by weight.

2) Heat treatment of the support:

The supports $A_1$ and $B_2$ were subjected to a heat treatment in the conditions shown in Tables 3 and 4. The supports subjected to the A process heat treatment are shown in Table 3 and the supports subjected to the B process heat treatment in Table 4.

This heat treatment was carried out after a heat fixing process through a rolling process in a layer forming process. When the high temperature rolling process was used, the base was rolled after it was heated to a prescribed temperature with an infrared heater installed immediately before a winding roller. After rolling, this roll was put in a constant temperature bath to subject it to a heat treatment at a prescribed temperature. When the transporting heat treatment process was used, a heat treating zone was provided after a heat fixing process. The inside of this zone was divided into 10 portions and a temperature was independently settled in each of them so that the treatment could be carried out either in the A process heat treatment or the B process heat treatment in which a controlled cooling speed is required.

In a steam treatment, the blowing port of steam was provided between the rolling equipment and the heat fixing process in the case of the high temperature rolling process, and between the heat fixing process and the heat treating zone in the case of the transporting heat treatment process to blow the steam on the base.

The example in which a wound roll, after cooling down to room temperature, was then placed at 110° C. for 24 hours as it was in a roll form was shown in $A_1$-26 as a comparative example to these examples of the present invention.

In all of these experiments, the support with the width of 1400 mm and the length of 1000 m was used and rolled on a roll core having the diameter of 300 mm with the winding tension of 20 kg.

3) Surface treatment of the support:

The supports $A_1$ and $B_1$, were subjected to a UV ray treatment on the respective both sides thereof. In the UV ray treatment, a UV ray was irradiated from the distance of 20 cm with a 1 kW high pressure mercury lamp for 30 seconds while heating to 200° C.

4) Coating of a subbing layer;

The following subbing solution was coated on this support in the amount of 10 ml/m$^2$ and dried at 115° C. for 2 minutes.

| | |
|---|---|
| Gelatin | 1 part |
| Distilled water | 1 part |
| Acetic acid | 1 part |
| Methanol | 50 parts |
| Ethylene dichloride | 50 parts |
| p-Chlorophenol | 4 parts |

The subbing solution of the following composition was coated on the support $C_1$ in the amount of 20 ml/m$^2$ and dried at 900° C. for 3 minutes.

| | |
|---|---|
| Gelatin | 275 parts |
| Formaldehyde | 12.1 parts |
| Salicylic acid | 82.4 parts |
| Methanol | 4372 parts |
| Methylene chloride | 22200 parts |
| Acetone | 31000 parts |
| Distilled water | 626 parts |

5) Coating of the back layer:

The back layer of the following composition was coated on the sides opposite to the sides of the supports $A_1$ to $C_1$, on which the subbing layers were provided, after subbing.

5-1) Preparation of a conductive fine particle dispersion (tin oxide-antimony oxide composite dispersing solution):

Stannic chloride hydrate 230 parts by weight and antimony trichloride 23 parts by weight were dissolved in ethanol 3,000 parts by weight to obtain an even solution. A 1N sodium hydroxide aqueous solution was dropped to this solution until pH of the above solution became 3 to thereby obtain the coprecipitate of colloidal stannic oxide and antimony oxide. The coprecipitate thus obtained was left for standing at 50° C. for 24 hours to obtain a red brown colloidal precipitate.

The red brown colloidal precipitate was separate by centrifugation. Water was added to the precipitate to wash it by centrifugation in order to remove excessive ions. This operation was repeated three times to remove the excess ions.

The colloidal precipitate 200 parts by weight from which the excess ions were removed was dispersed once again into water 1,500 parts by weight and the dispersion was sprayed into a kiln heated to 600° C., whereby there was obtained the bluish fine particle powder of tin oxide-antimony oxide having the average particle size of 0.2 μm. The specific resistance of this fine particle powder was 25 Ω.cm.

After the mixed solution of the above fine particle powder 40 parts by weight and water 60 parts by weight was adjusted to pH 7.0 and roughly dispersed with a stirrer, it was dispersed with a horizontal type sand mill (brand name Daino Mill: manufactured by WILLYA BACHOFENAG) until the staying time became 30 minutes to thereby prepare the prescribed dispersing solution.

5-2) Coating of the back layer:

The following composition [$A_1$] was coated so that a dry layer thickness became 0.3 μm and dried at 110° C. for 30 seconds. The following covering coating solution ($B_1$) was further coated thereon so that a dry layer thickness became 0.1 μm.

| | |
|---|---|
| [Composition $A_1$] | |
| Above conductive fine particle dispersion | 10 parts |
| Gelatin | 1 part |
| Water | 27 parts |
| Methanol | 60 parts |
| Resorcin | 2 parts |
| Polyoxyethylene nonylphenyl ether | 0.01 part |
| [Covering coating solution ($B_1$)] | |
| Cellulose triacetate | 1 part |
| Acetone | 70 parts |
| Methanol | 15 parts |
| Dichloromethylene | 10 parts |
| p-Chlorophenol | 4 parts |

6) Coating of the light-sensitive layers:

The respective layers of the compositions shown below were simultaneously coated on the supports obtained by the above process to prepare the multi-layer color light-sensitive materials $A_1$-1 to $A_1$-26, $A_1$-101 to $A_1$-121, $B_1$,-1, and $C_1$-1 to $C_1$,-2.

Composition of the light-sensitive layer

The primary materials used for the respective layers are classified as follows:

| | | |
|---|---|---|
| ExC: Cyan coupler | UV: | UV absorber |
| ExM: Magenta coupler | HBS: | High boiling solvent |
| ExY: Yellow coupler | H: | Gelatin hardener |
| ExS: Sensitizing dye | | |

The numerals corresponding to the respective components represent the coated amounts in terms of a g/m$^2$ unit and the coated amounts converted to silver in case of silver halide. Provided that in case of the sensitizing dyes, the coated amount per mole of silver halide contained in the same layer is shown in terms of a mole unit.

| | | |
|---|---|---|
| First layer (antihalation layer): | | |
| Black colloidal silver | silver | 0.18 |
| Gelatin | | 1.40 |
| ExM-1 | | 0.18 |
| ExF-1 | | $2.0 \times 10^{-3}$ |
| HBS-1 | | 0.20 |
| Second layer (intermediate layer): | | |
| Emulsion G | silver | 0.065 |
| 2,5-Di-t-pentadecylhydroquinone | | 0.18 |
| ExC-2 | | 0.020 |
| UV-1 | | 0.060 |
| UV-2 | | 0.080 |
| UV-3 | | 0.10 |
| HBS-1 | | 0.10 |
| HBS-2 | | 0.020 |
| Gelatin | | 1.04 |
| Third layer (low-sensitivity red-sensitive emulsion layer): | | |
| Emulsion A | silver | 0.25 |
| Emulsion B | silver | 0.25 |
| ExS-1 | | $6.9 \times 10^{-5}$ |
| ExS-2 | | $1.8 \times 10^{-5}$ |
| ExS-3 | | $3.1 \times 10^{-4}$ |
| ExC-1 | | 0.17 |
| ExC-3 | | 0.030 |
| ExC-4 | | 0.10 |
| ExC-5 | | 0.020 |
| ExC-7 | | 0.0050 |
| ExC-8 | | 0.010 |
| Cpd-2 | | 0.025 |
| HBS-1 | | 0.10 |
| Gelatin | | 0.87 |
| Fourth layer (middle-sensitivity red-sensitive emulsion layer): | | |
| Emulsion | silver | 0.70 |
| ExS-1 | | $3.5 \times 10^{-4}$ |
| ExS-2 | | $1.6 \times 10^{-5}$ |
| ExS-3 | | $5.1 \times 10^{-4}$ |
| ExC-1 | | 0.13 |
| ExC-2 | | 0.060 |
| ExC-3 | | 0.0070 |
| ExC-4 | | 0.090 |
| ExC-5 | | 0.025 |
| ExC-7 | | 0.0010 |
| ExC-8 | | 0.0070 |
| Cpd-2 | | 0.023 |
| HBS-1 | | 0.10 |

-continued

| | | |
|---|---|---|
| Gelatin | | 0.75 |
| Fifth layer (high-sensitivity red-sensitive emulsion layer): | | |
| Emulsion E | silver | 1.40 |
| ExS-1 | | $2.4 \times 10^{-4}$ |
| ExS-2 | | $1.0 \times 10^{-4}$ |
| ExS-3 | | $3.4 \times 10^{-4}$ |
| ExC-1 | | 0.12 |
| ExC-3 | | 0.045 |
| ExC-6 | | 0.020 |
| ExC-8 | | 0.025 |
| Cpd-2 | | 0.050 |
| HBS-1 | | 0.22 |
| HBS-2 | | 0.10 |
| Gelatin | | 1.20 |
| Sixth layer (intermediate layer): | | |
| Cpd-1 | | 0.10 |
| HBS-1 | | 0.50 |
| Gelatin | | 1.10 |
| Seventh layer (low-sensitivity green-sensitive emulsion layer): | | |
| Emulsion C | silver | 0.35 |
| ExS-4 | | $3.0 \times 10^{-5}$ |
| ExS-5 | | $2.1 \times 10^{-4}$ |
| ExS-6 | | $8.0 \times 10^{-4}$ |
| ExM-1 | | 0.010 |
| ExM-2 | | 0.33 |
| ExM-3 | | 0.086 |
| ExY-1 | | 0.015 |
| HBS-1 | | 0.30 |
| HBS-3 | | 0.010 |
| Gelatin | | 0.73 |
| Eighth layer (middle-sensitivity green-sensitive emulsion layer): | | |
| Emulsion D | silver | 0.80 |
| ExS-4 | | $3.2 \times 10^{-5}$ |
| ExS-5 | | $2.2 \times 10^{-4}$ |
| ExS-6 | | $8.4 \times 10^{-4}$ |
| ExM-2 | | 0.13 |
| ExM-3 | | 0.030 |
| ExY-1 | | 0.018 |
| HBS-1 | | 0.16 |
| HBS-3 | | $8.0 \times 10^{-3}$ |
| Gelatin | | 0.90 |
| Ninth layer (high-sensitivity green-sensitive emulsion layer): | | |
| Emulsion E | silver | 1.25 |
| ExS-4 | | $3.7 \times 10^{-5}$ |
| ExS-5 | | $8.1 \times 10^{-5}$ |
| ExS-6 | | $3.2 \times 10^{-4}$ |
| ExC-1 | | 0.010 |
| ExM-1 | | 0.030 |
| ExM-4 | | 0.040 |
| ExM-5 | | 0.019 |
| Cpd-3 | | 0.040 |
| HBS-1 | | 0.25 |
| HBS-2 | | 0.10 |
| Gelatin | | 1.44 |
| Tenth layer (yellow filter layer): | | |
| Yellow colloidal silver | silver | 0.030 |
| Cpd-3 | | 0.16 |
| HBS-1 | | 0.60 |
| Gelatin | | 0.60 |
| Eleventh layer (low-sensitivity blue-sensitive emulsion layer): | | |
| Emulsion C | silver | 0.18 |
| ExS-7 | | $8.6 \times 10^{-4}$ |
| ExY-1 | | 0.020 |
| ExY-2 | | 0.22 |
| ExY-3 | | 0.50 |
| ExY-4 | | 0.020 |
| HBS-1 | | 0.28 |

-continued

| | |
|---|---|
| Gelatin | 1.10 |
| Twelfth layer (middle-sensitivity blue-sensitive emulsion layer): | |
| Emulsion D | silver 0.40 |

into the respective layers in order to improve preservation performance, processing performance, antipressure performance, antimold and fungicidal performances, antistatic performance, and coating performance The compositions of the emulsions used in the respective layers will be shown below:

TABLE 2

| Emulsion | Average AgI content (%) | Average grain size (μm) | Grain size fluctuation (%) | Diameter/thickness ratio | Silver amount ratio [Core/middle/shell] (AgI content) | Grain structure/form |
|---|---|---|---|---|---|---|
| A | 4.0 | 0.45 | 27 | 1 | [1/3] (13/1) | Double structure octahedron grain |
| B | 8.9 | 0.70 | 14 | 1 | [3/7] (25/2) | Double structure octahedron grain |
| C | 2.0 | 0.55 | 25 | 7 | — | Even structure tabular grain |
| D | 9.0 | 0.65 | 25 | 6 | [12/59/29] (0/11/8) | Triple structure tabular grain |
| E | 9.0 | 0.85 | 23 | 5 | [8/59/33] (0/11/8) | Triple structure tabular grain |
| F | 14.5 | 1.25 | 25 | 3 | [37/63] (34/3) | Double structure tabular grain |
| G | 1.0 | 0.07 | 15 | 1 | — | Even structure fine grain |

In Table 2:
(1) Emulsions A to F were subjected to a reduction sensitization with thiourea dioxide and thiosulfonic acid in the preparation of the grains according to the examples of JP-A-2-191938
(2) Emulsions A to F were subjected to a gold sensitization, a sulfur sensitization, and a selenium sensitization in the presence of the spectral sensitizing dyes described in the above respective layers and sodium thiocyanate according to the examples of JP-A-3-237450
(3) Low molecular weight gelatin was used in the preparation of the tabular grains according to the examples of JP-A-1-158426

(4) The dislocation lines described in JP-A-3-237450 were observed in the tabular grains and regular crystal grains having a grain structure with a high pressure electron microscope -continued

| | |
|---|---|
| ExS-7 | $7.4 \times 10^{-4}$ |
| ExC-7 | $7.0 \times 10^{-3}$ |
| ExY-2 | 0.050 |
| ExY-3 | 0.10 |
| HBS-1 | 0.050 |
| Gelatin | 0.78 |
| Thirteenth layer (high-sensitivity blue-sensitive emulsion layer): | |
| Emulsion F | silver 1.00 |
| ExS-7 | $4.0 \times 10^{4}$ |
| ExY-2 | 0.10 |
| ExY-3 | 0.10 |
| HBS-1 | 0.070 |
| Gelatin | 0.86 |
| Fourteenth layer (first protective layer): | |
| Emulsion G | silver 0.20 |
| UV-4 | 0.11 |
| UV-5 | 0.17 |
| HBS-1 | $5.0 \times 10^{-2}$ |
| Gelatin | 1.00 |
| Fifteenth layer (second protective layer): | |
| H-1 | 0.40 |
| B-1 (diameter: 1.7 μm) | $5.0 \times 10^{-2}$ |
| B-2 (diameter: 1.7 μm) | 0.10 |
| B-3 | 0.10 |
| S-1 | 0.20 |
| Gelatin | 1.20 |

Further, the compounds of W-1 to W-3, B-4 to B-6, and F-1 to F-17, an iron salt, a lead salt, a gold salt, a platinum salt, an iridium salt, and a rhodium salt were incorporated The chemical formulae of the compounds used in coating the light-sensitive layers will be shown below:

ExC-1
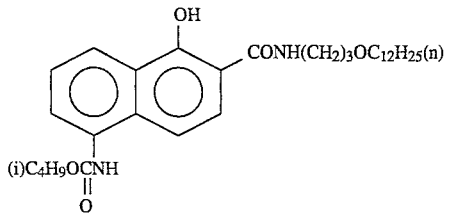
ExC-2
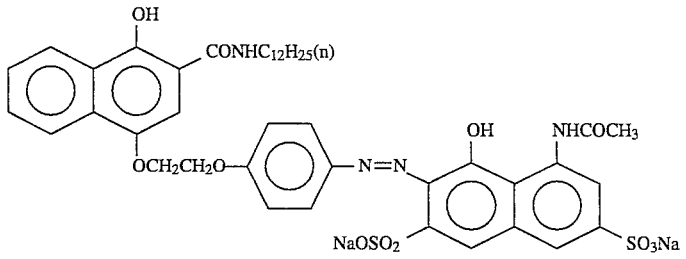
ExC-3
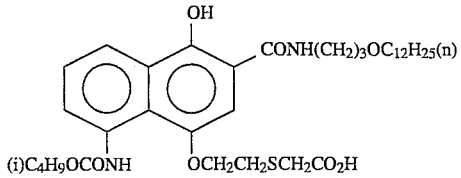
ExC-4
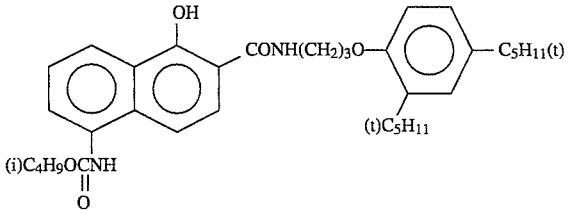
ExC-5
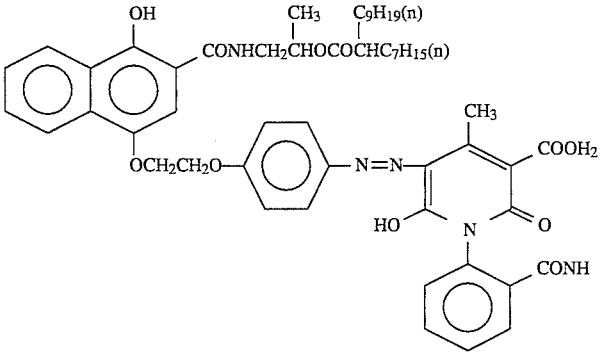
ExC-6
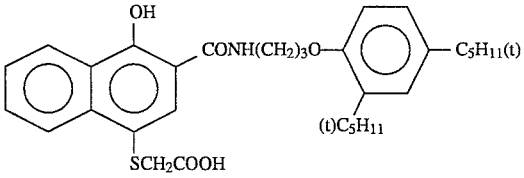

-continued
ExC-7
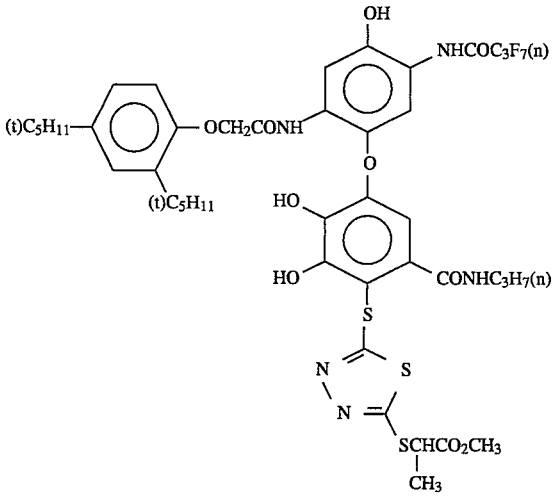
ExC-8
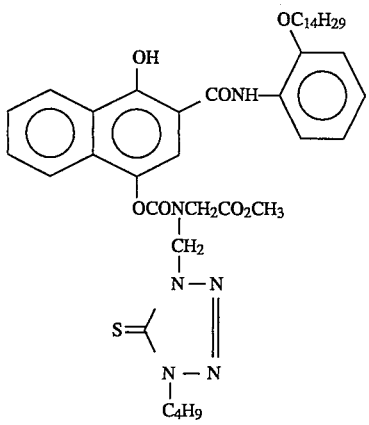
ExM-1
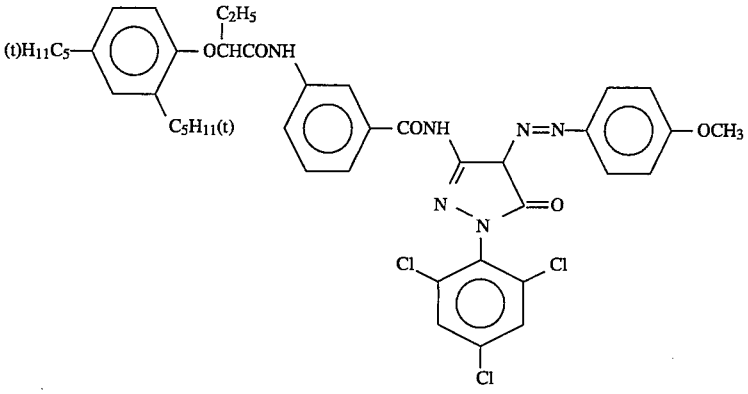

-continued
ExM-2
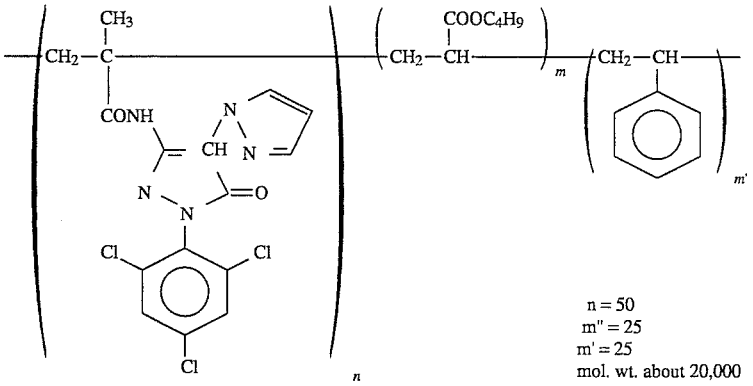
ExM-3
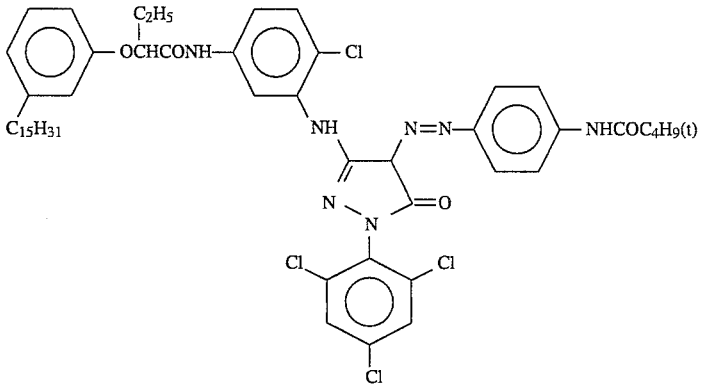
ExM-4
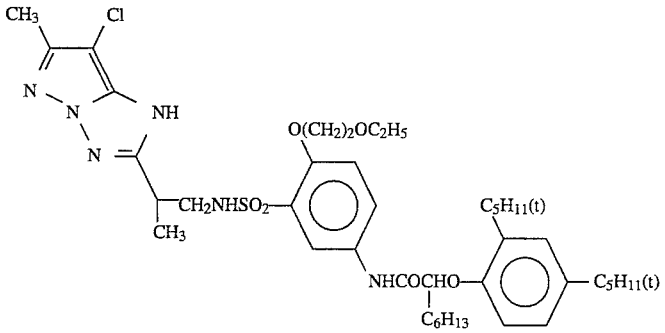
ExM-5
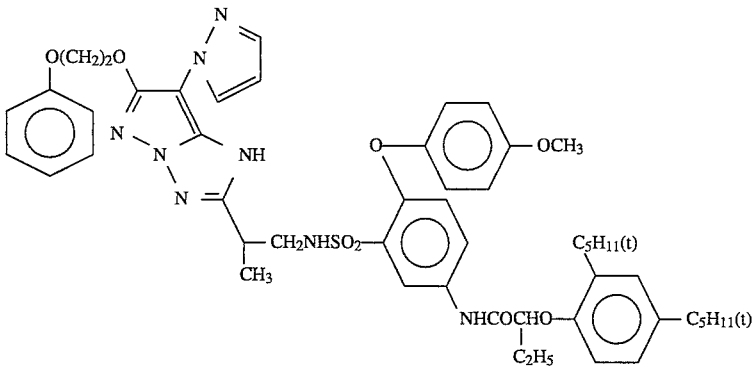

-continued
ExY-1
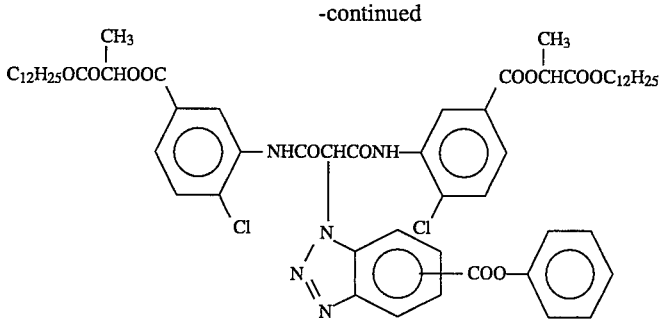
ExY-2
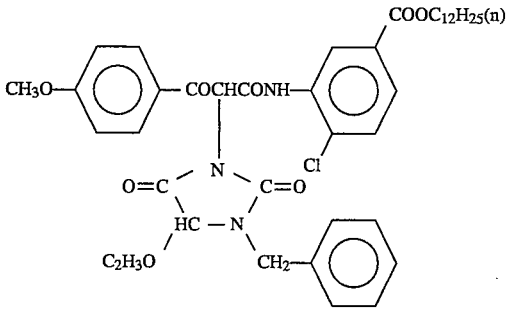
ExY-3
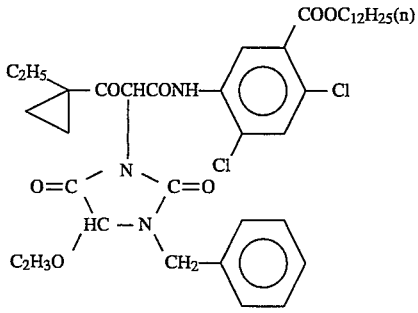
ExY-4
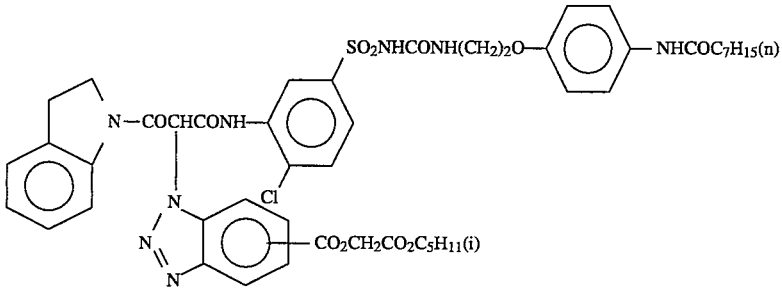
ExF-1
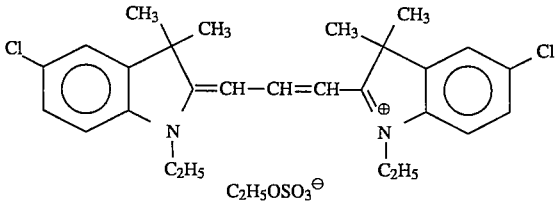
Cpd-1
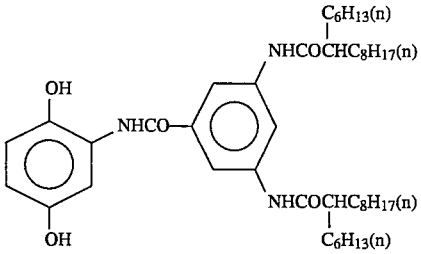
Cpd-2
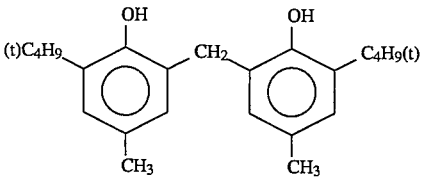
Cpd-3
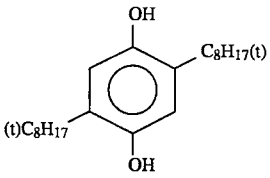
UV-1
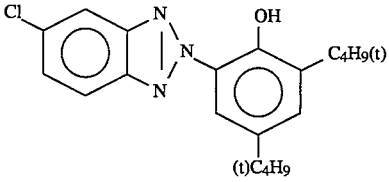

-continued
UV-2
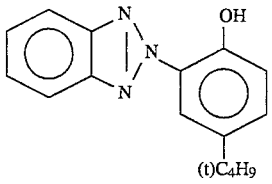
UV-3
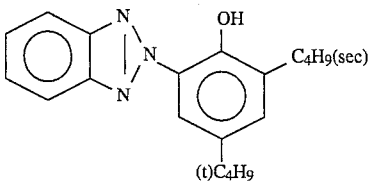
UV-4
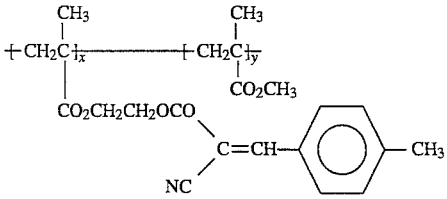
x:y = 70:30 (wt %)
UV-5
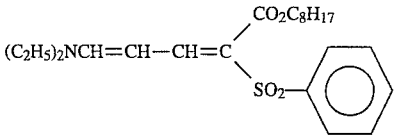
ExS-1
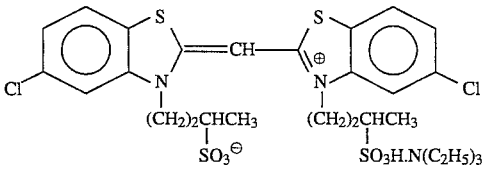
Tricresyl phosphate
HBS-1
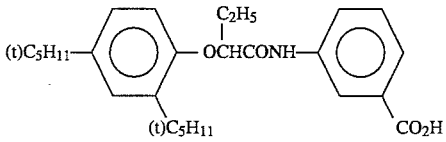
Di-n-butyl phthalate
HBS-2
HBS-3
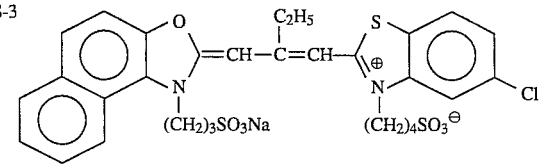
ExS-1
ExS-2
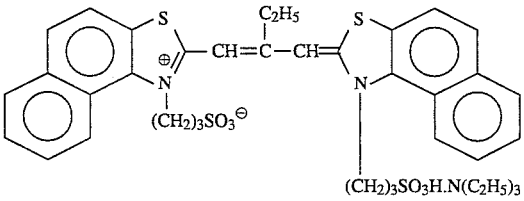
ExS-3
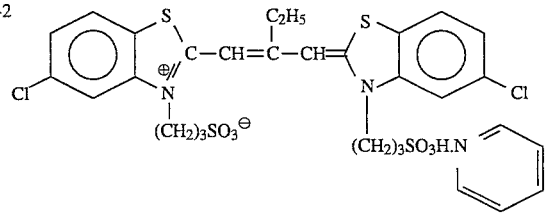
ExS-4
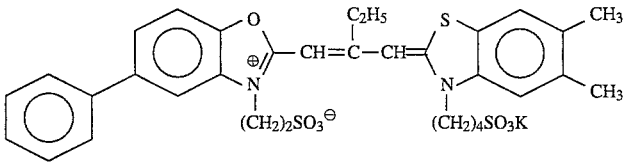
ExS-5
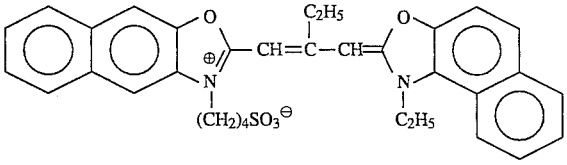
ExS-6
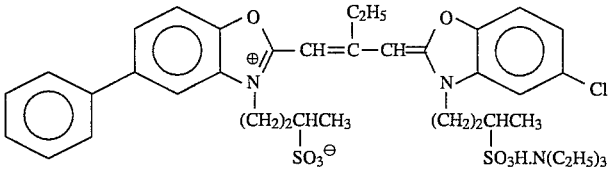

-continued
ExS-7
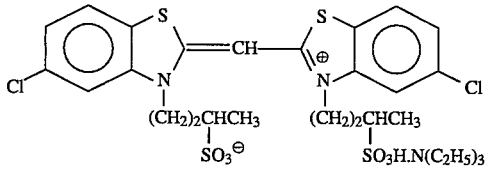
H-1
$CH_2{=}CH{-}SO_2{-}CH_2{-}CONH{-}CH_2$
$CH_2{=}CH{-}SO_2{-}CH_2{-}CONH{-}CH_2$
B-2
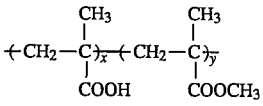
x/y = 40/60
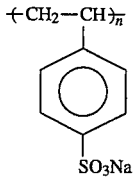
B-4
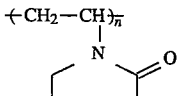
(mol. wt. about 10,000)
B-6
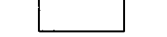
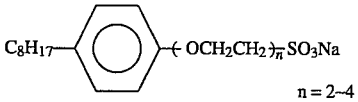
n = 2~4
W-2
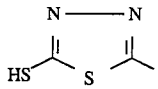
F-1
F-3
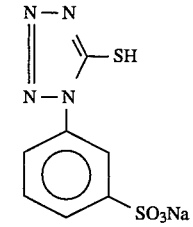
F-5
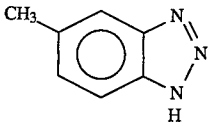
S-1
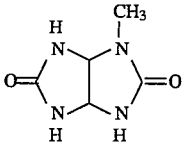
B-1
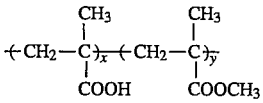
x/y = 10/90
B-3
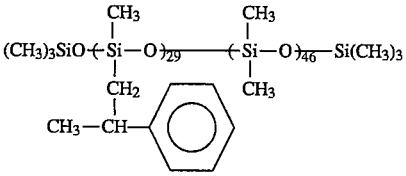
B-5
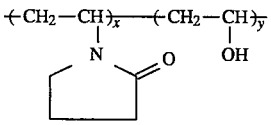
x/y = 70/30
W-1
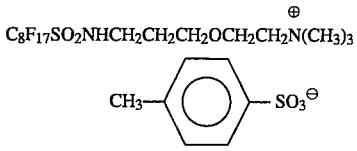
W-3
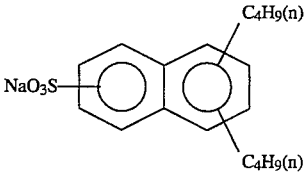
F-2
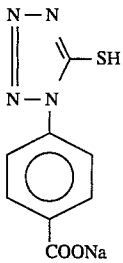
F-4
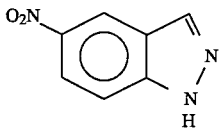
F-6
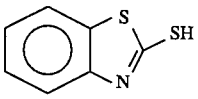

-continued

F-7

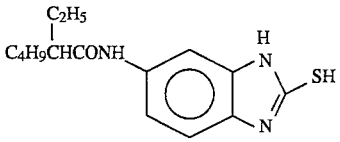

F-8

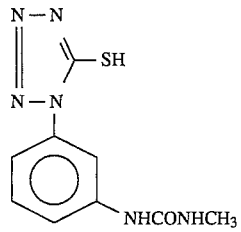

F-9

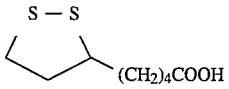

F-10

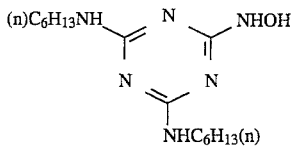

F-11

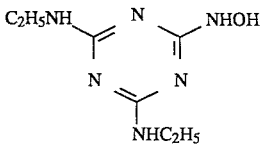

F-12

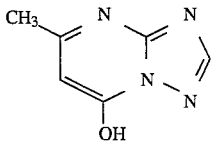

F-13

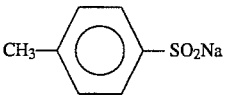

F-14

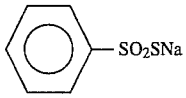

F-15

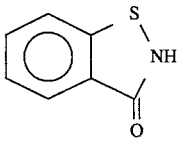

F-16

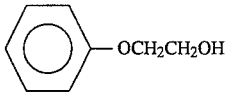

F-17

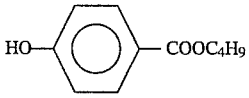

7) Sample evaluation:

The samples thus prepared were subjected to the following evaluations. A handling property, a shrinkage, a water content, an endothermic amount of an endothermic peak including Tg, a face condition, and a coloring were evaluated for a base after preparation, and a curling habit, a pressure fog, and a gutter-form curl were evaluated for a film coated with the light-sensitive layers. The evaluations were carried out according to the following procedures.

7-1) Curling habit:

(1) Core set

A sample film was slit to the width of 35 mm and the length of 1.2 m. After this was subjected to a humidity conditioning at 25° C. and 60% RH for a night, it was rolled on a spool of 4 to 12 mm with a light-sensitive layer inside. This was put in a sealed vessel and heated at 80° C. for 2 hours to form a curling habit. This temperature condition was based on the assumption that film is left in a car during the day in the summer season.

(2) Development processing and a curl measurement

After the film on which the curling habit was formed at the above condition was left for cooling in a room of 25° C. for a night, the sample was taken-out from the sealed vessel and subjected to a development processing with an automatic developing machine (Mini Lab FP-55OB: manufactured by Fuji Photo Film Co., Ltd.), followed by immediately carrying out the curl measurement with a curl plate at 25° C. and 60% RH. The sample having the strong curling habit was pressed with a nip roll to generate a heel folding. The presence thereof was evaluated, and x was marked on generation and o was marked on no generation.

The development processing conditions are as follows.

| Processing step | Temperature | Time |
|---|---|---|
| Color developing | 38° C. | 3 minutes |
| Stopping | 38° C. | 1 minute |
| Washing | 38° C. | 1 minute |
| Bleaching | 38° C. | 2 minutes |
| Washing | 38° C. | 1 minute |
| Fixing | 38° C. | 2 minutes |
| Washing | 38° C. | 1 minute |
| Stabilizing | 38° C. | 1 minute |

The processing solutions used have the following compositions.

| Color developing solution: | |
|---|---|
| Caustic soda | 2 g |
| Sodium sulfite | 2 g |
| Potassium bromide | 0.4 g |
| Sodium chloride | 1 g |
| Borax | 4 g |
| Hydroxylamine sulfate | 2 g |
| Disodium ethylenediaminetetracetate dihydrate | 2 g |
| 4-Amino-3-methyl-N-ethyl-N-(β-hydroxyl- | 4 g |

-continued

| | |
|---|---|
| ethyl)aniline monosulfate | |
| Water to make | 1 liter |
| Stopping solution: | |
| Sodium thiosulfate | 10 g |
| Ammonium thiosulfate (70% aqueous solution) | 30 ml |
| Acetic acid | 30 ml |
| Sodium acetate | 5 g |
| Potassium alum | 15 g |
| Water to make | 1 liter |
| Bleaching solution: | |
| Iron (III) sodium ethylenediamine-tetraacetate dehydrate | 100 g |
| Potassium bromide | 50 g |
| Ammonium nitrate | 50 g |
| Boric acid | 5 g |
| Ammonia water adjusting pH to | 5.0 |
| Water to make | 1 liter |
| Fixing solution: | |
| Sodium thiosulfate | 150 g |
| Sodium sulfite | 15 g |
| Borax | 12 g |
| Acetic acid glacial | 15 ml |
| Potassium alum | 20 g |
| Water to make | 1 liter |
| Stabilizing solution: | |
| Boric acid | 5 g |
| Sodium citrate | 5 g |
| Sodium methaborate(tetrahydrate) | 3 g |
| Potassium alum | 15 g |
| Water to make | 1 liter |

7-2) Gutter-form curl:

After the sample provided with the light-sensitive layers was slit to the width of 35 mm and the length of 1.2 m, it was subjected to a humidity conditioning at 25° C. and 10% RH for a night and then put on a flat stand so that the light-sensitive layer was turned downward. Then, the height thereof was measured with calipers. Sample $C_1$-1 was set as a standard, and in Tables 3 and 4 x was marked to those having the larger values than this and o was marked to those having the values equivalent to or smaller than this.

7-3) Pressure fog:

After the sample provided with the light-sensitive layers was slit to the width of 35 mm and the length of 1.2 m, it was rolled on a spool shown in Tables 2 and 3 to leave for standing for 30 minutes. Then, it was subjected to a development processing by the developing process described above and a fog was visually evaluated. In Tables 3 and 4 x was marked to those having the generation of the fog and o was marked to those having no generation of the fog.

7-4) Coloring:

A base which was subjected to the heat treatment was measured with a UV-visible ray spectrophotometer. A base prior to heat treatment was put into a reference part and a base after heat treatment was put into a sample part. In Tables 3 and 4, those having the absorbance of 0.05 or more in 450 nm was evaluated as x and those having the absorbance of less than 0.05 as o.

7-5) Face condition:

A base which was subjected to the heat treatment was visually evaluated for the generation of an irregularity and the flatness of a surface. The base prior to heat treatment was set as a standard. In Tables 3 and 4, those equivalent to this was evaluated as o and those inferior to this as x.

7-6) Shrinkage:

Comparing the width of a base before the heat treatment with that of a base after the heat treatment, in Tables 3 and 4, those shrunk by 0.5% or more was marked with x and those shrunk less than this with o.

7-7) Handling property:

Those generating trouble originating from the extension of the base were marked with x and those generating no such trouble with o.

7-8) Water content:

A base was sampled immediately after a steam treatment process and this was put in a sealed glass vessel, followed by measuring with a trace moisture meter (CA-02 type manufactured by Mitsubishi Kasei Corporation) at the dry temperature of 150° C.

7-9) Endothermic amount of an endothermic peak including Tg:

The endothermic amount was measured with DSC according to the process defined previously.

8) Results:

The results are shown in Tables 3 and 4 below. The results obtained with the A process heat treatment are shown in Table 3 and those obtained with the B process heat treatment in Table 4.

TABLE 3

| | | | | Pre-heat treatment | | | A process heat treatment | | | Steam treatment | | | Endo-thermic |
|---|---|---|---|---|---|---|---|---|---|---|---|---|---|
| Sample | Sup-port | Thick-ness μm | Tg °C. | Tempera-ture °C. | Time min. | Proc-ess* | Tempera-ture °C. | Time min. | Proc-ess* | Tempera-ture °C. | Time min. | Water con-tent % | amount** mcal/g |
| $A_1$-1 | PEN | 85 | 119 | — | — | — | 115 | 0.15 | High | — | — | — | 110 |
| $A_1$-2 | PEN | 85 | 119 | — | — | — | 115 | 0.05 | High | — | — | — | 95 |
| $A_1$-3 | PEN | 85 | 119 | — | — | — | 60 | 1400 | High | — | — | — | 900 |
| $A_1$-4 | PEN | 85 | 119 | — | — | — | 60 | 1600 | High | — | — | — | 1100 |
| $A_1$-5 | PEN | 85 | 119 | — | — | — | 40 | 1400 | High | — | — | — | 90 |
| $A_1$-6 | PEN | 85 | 119 | — | — | — | 125 | 0.15 | High | — | — | — | 30 |
| $A_1$-7 | PEN | 85 | 119 | — | — | — | 110 | 16 | High | — | — | — | 310 |
| $A_1$-B | PEN | 85 | 119 | 115 | $10^5$ | High | 110 | 16 | High | — | — | — | 320 |
| $A_1$-9 | PEN | 85 | 119 | 125 | 0.1 | High | 110 | 16 | High | — | — | — | 360 |
| $A_1$-10 | PEN | 85 | 119 | 125 | $8 \times 10^4$ | High | 110 | 16 | High | — | — | — | 410 |
| $A_1$-11 | PEN | 85 | 119 | 125 | $10^5$ | High | 110 | 16 | High | — | — | — | 420 |
| $A_1$-12 | PEN | 85 | 119 | 260 | 0.1 | High | 110 | 16 | High | — | — | — | 380 |
| $A_1$-13 | PEN | 85 | 119 | 240 | 0.1 | High | 110 | 16 | High | — | — | — | 370 |
| $A_1$-14 | PEN | 85 | 119 | 240 | 0.05 | High | 110 | 16 | High | — | — | — | 315 |
| $A_1$-15 | PEN | 85 | 119 | 150 | 5 | High | 110 | 16 | High | — | — | 0.1 | 390 |
| $A_1$-16 | PEN | 85 | 119 | 150 | 5 | High | 110 | 16 | High | 110 | 1 | 0.2 | 420 |
| $A_1$-17 | PEN | 85 | 119 | 150 | 5 | High | 110 | 16 | High | 110 | 35 | 4.8 | 870 |

TABLE 3-continued

| | | | | | | | | | | | | | |
|---|---|---|---|---|---|---|---|---|---|---|---|---|---|
| $A_1$-18 | PEN | 85 | 119 | 150 | 5 | High | 110 | 16 | High | 110 | 45 | 5.2 | 1050 |
| $A_1$-19 | PEN | 85 | 119 | 150 | 5 | Tran | 110 | 0.5 | Tran | — | — | — | 280 |
| $A_1$-20 | PEN | 85 | 119 | 150 | 5 | Tran | 110 | 0.5 | Tran | 110 | 5 | 1.2 | 320 |
| $A_1$-21 | PEN | 85 | 119 | 150 | 5 | Tran | 110 | 0.5 | Tran | 110 | 5 | 1.2 | 320 |
| $A_1$-22 | PEN | 85 | 119 | 150 | 5 | Tran | 110 | 0.5 | Tran | 110 | 5 | 1.2 | 320 |
| $A_1$-23 | PEN | 85 | 119 | 150 | 5 | Tran | 110 | 0.5 | Tran | 110 | 5 | 1.2 | 320 |
| $A_1$-24 | PEN | 85 | 119 | — | — | — | — | — | — | — | — | — | 0 |
| $A_1$-25 | PEN | 85 | 119 | — | — | — | — | — | — | — | — | — | 0 |
| $A_1$-26 | PEN | 85 | 119 | — | — | — | | ** | | — | — | — | 310 |

Note:
High: High temperature rolling process.
Tran: Transporting heat treating process.
*Endothermic amount in an endothermic peak including Tg.
**Support was once cooled to a room temperature and tolled to heat at 110° C. for 24 hours.

| Sample | | Handling property | Face condition | Shrink-Shrinkage | Color-Coloring | Gutter-form curl | Pressure fog | Curling habit: Core size (mm) | Curl* | Curl** | Heel folding |
|---|---|---|---|---|---|---|---|---|---|---|---|
| $A_1$-1 | (Inv.) | o | o | o | o | o | o | 7 | 91 | 58 | o |
| $A_1$-2 | (Comp.) | o | o | o | o | o | o | 7 | 101 | 67 | x |
| $A_1$-3 | (Inv.) | o | o | o | o | o | o | 7 | 69 | 35 | o |
| $A_1$-4 | (Comp.) | o | o | o | o | o | o | 7 | 69 | 34 | o |
| $A_1$-5 | (Comp.) | o | o | o | o | o | o | 7 | 95 | 63 | x |
| $A_1$-6 | (Comp.) | o | o | o | o | o | o | 7 | 135 | 103 | x |
| $A_1$-7 | (Inv.) | o | o | o | o | o | o | 7 | 81 | 48 | o |
| $A_1$-8 | (Comp.) | o | o | o | o | o | o | 7 | 78 | 47 | o |
| $A_1$-9 | (Inv.) | o | o | o | o | o | o | 7 | 71 | 42 | o |
| $A_1$-10 | (Inv.) | o | o | o | o | o | o | 7 | 66 | 35 | o |
| $A_1$-11 | (Comp.) | o | o | o | x | o | o | 7 | 68 | 34 | o |
| $A_1$-12 | (Comp.) | x | o | o | o | o | o | 7 | 72 | 40 | o |
| $A_1$-13 | (Inv.) | o | o | o | o | o | o | 7 | 73 | 42 | o |
| $A_1$-14 | (Comp.) | x | o | o | o | o | o | 7 | 81 | 47 | o |
| $A_1$-15 | (Inv.) | o | o | o | o | o | o | 7 | 76 | 43 | o |
| $A_1$-16 | (Inv.) | o | o | o | o | o | o | 7 | 69 | 37 | o |
| $A_1$-17 | (Inv.) | o | o | o | o | o | o | 7 | 66 | 34 | o |
| $A_1$-18 | (Comp.) | o | o | x | o | o | o | 7 | 64 | 33 | o |
| $A_1$-19 | (Inv.) | o | o | o | o | o | o | 7 | 79 | 48 | o |
| $A_1$-20 | (Inv.) | o | o | o | o | o | o | 7 | 76 | 44 | o |
| $A_1$-21 | (Comp.) | o | o | o | o | o | x | 4 | 98 | 66 | x |
| $A_1$-22 | (Inv.) | o | o | o | o | o | o | 5 | 92 | 60 | o |
| $A_1$-23 | (Inv.) | o | o | o | o | o | o | 11 | 61 | 33 | o |
| $A_1$-24 | (Comp.) | o | o | o | o | o | o | 11 | 95 | 63 | x |
| $A_1$-25 | (Comp.) | o | o | o | o | o | o | 12 | 89 | 59 | o |
| $A_1$-26 | (Comp.) | o | x | o | o | o | o | 7 | 85 | 55 | o |

*Before development
**After development

TABLE 4

| Sample | Support | Thickness μm | Tg °C. | Preheat treatment: Temperature °C. | Preheat treatment: Time min. | Preheat treatment: Process* | B process heat treatment: Coolling speed* | B process heat treatment: Process* | Steam treatment: Temperature °C. | Steam treatment: Time min. | Steam treatment: Water content % | Endothermic amount** mcal/g |
|---|---|---|---|---|---|---|---|---|---|---|---|---|
| $A_1$-101 | PEN | 85 | 119 | — | — | — | −22 | Tran | — | — | — | 85 |
| $A_1$-102 | PEN | 85 | 119 | — | — | — | −18 | Tran | — | — | — | 120 |
| $A_1$-103 | PEN | 85 | 119 | — | — | — | −0.02 | Tran | — | — | — | 450 |
| $A_1$-104 | PEN | 85 | 119 | — | — | — | −0.005 | Tran | — | — | — | 550 |
| $A_1$-105 | PEN | 85 | 119 | — | — | — | 2 | Tran | — | — | — | 300 |
| $A_1$-106 | PEN | 85 | 119 | — | — | — | 2 | Tran | — | — | — | 310 |
| $A_1$-107 | PEN | 85 | 119 | 115 | $10^5$ | Tran | 2 | Tran | — | — | — | 350 |
| $A_1$-108 | PEN | 85 | 119 | 125 | 0.1 | Tran | 2 | Tran | — | — | — | 400 |
| $A_1$-109 | PEN | 85 | 119 | 125 | $8 \times 10^4$ | Tran | 2 | Tran, | — | — | — | 410 |
| $A_1$-110 | PEN | 85 | 119 | 125 | $10^5$ | Tran | 2 | Tran | — | — | — | 370 |
| $A_1$-111 | PEN | 85 | 119 | 260 | 0.1 | Tran | 2 | Tran | — | — | — | 360 |
| $A_1$-112 | PEN | 85 | 119 | 240 | 0.1 | Tran | 2 | Tran | — | — | — | 305 |
| $A_1$-113 | PEN | 85 | 119 | 240 | 0.05 | Tran | 2 | Tran | — | — | 0.1 | 380 |
| $A_1$-114 | PEN | 85 | 119 | 150 | 5 | Tran | 2 | Tran | 110 | 1 | 0.2 | 420 |
| $A_1$-115 | PEN | 85 | 119 | 150 | 5 | Tran | 2 | Tran | 110 | 35 | 4.8 | 920 |
| $A_1$-116 | PEN | 85 | 119 | 150 | 5 | Tran | 2 | Tran | 110 | 45 | 5.2 | 1030 |
| $A_1$-117 | PEN | 85 | 119 | 150 | 30 | High | -0.1 | High | — | — | — | 330 |
| $A_1$-118 | PEN | 85 | 119 | 150 | 30 | High | -0.1 | High | 110 | 5 | 1.0 | 360 |

TABLE 4-continued

| | | | | | | | | | | | | |
|---|---|---|---|---|---|---|---|---|---|---|---|---|
| $A_1$-119 | PEN | 85 | 119 | 150 | 5 | Tran | -0.1 | High | 110 | 5 | 1.0 | 320 |
| $A_1$-120 | PEN | 70 | 119 | 150 | 5 | Tran | 2 | Tran | 110 | 5 | 1.0 | 330 |
| $A_1$-121 | PEN | 50 | 119 | 150 | 5 | Tran | 2 | Tran | 110 | 5 | 1.0 | 330 |
| $B_1$-1 | PET | 90 | 69 | 120 | 5 | Tran | 2 | Tran | — | — | — | 280 |
| $C_1$-1 | TAC | 122 | 120 | — | — | — | — | — | — | — | — | 0 |
| $C_1$-2 | TAC | 110 | 120 | — | — | — | — | — | — | — | — | 0 |

*Average cooling speed between Tg and Tg −40° C., ° C./minute.
**Tran: transporting heat treating process.
High: high temperature rolling process.
***Endothermic amount in an endothermic peak including Tg

| Sample | | Handling property | Face condition | Shrinkage | Coloring | Gutter-form curl | Pressure fog | Curling habit: Core size (mm) | Curl* | Curl** | Heel folding |
|---|---|---|---|---|---|---|---|---|---|---|---|
| $A_1$-101 | (Comp.) | o | o | o | o | o | o | 7 | 91 | 58 | o |
| $A_1$-102 | (Inv.) | o | o | o | o | o | o | 7 | 86 | 58 | o |
| $A_1$-103 | (Inv.) | o | o | o | o | o | o | 7 | 62 | 33 | o |
| $A_1$-104 | (Comp.) | o | o | o | o | o | o | 7 | 62 | 32 | o |
| $A_1$-105 | (Inv.) | o | o | o | o | o | o | 7 | 75 | 47 | o |
| $A_1$-106 | (Comp.) | o | o | o | o | o | o | 7 | 78 | 48 | o |
| $A_1$-107 | (Inv.) | o | o | o | o | o | o | 7 | 70 | 41 | o |
| $A_1$-108 | (Inv.) | o | o | o | o | o | o | 7 | 66 | 36 | o |
| $A_1$-109 | (Comp.) | o | o | o | x | o | o | 7 | 65 | 37 | o |
| $A_1$-110 | (Comp.) | x | o | o | o | o | o | 7 | 71 | 39 | o |
| $A_1$-111 | (Inv.) | o | o | o | o | o | o | 7 | 72 | 40 | o |
| $A_1$-112 | (Comp.) | o | o | o | o | o | o | 7 | 75 | 48 | o |
| $A_1$-113 | (Inv.) | o | o | o | o | o | o | 7 | 71 | 42 | o |
| $A_1$-114 | (Inv.) | o | o | o | o | o | o | 7 | 69 | 38 | o |
| $A_1$-115 | (Inv.) | o | o | o | o | o | o | 7 | 62 | 31 | o |
| $A_1$-116 | (Comp.) | o | o | x | o | o | o | 7 | 60 | 30 | o |
| $A_1$-117 | (Inv.) | o | o | o | o | o | o | 7 | 78 | 47 | o |
| $A_1$-118 | (Inv.) | o | o | o | o | o | o | 7 | 74 | 45 | o |
| $A_1$-119 | (Inv.) | o | o | a | o | o | o | 7 | 77 | 48 | o |
| $A_1$-120 | (Inv.) | o | o | o | o | o | o | 7 | 80 | 49 | o |
| $A_1$-121 | (Comp.) | o | o | o | o | x | o | 7 | 82 | 50 | o |
| $B_1$-1 | (Comp.) | o | o | o | o | o | o | 7 | 221 | 200 | x |
| $C_1$-1 | (Comp.) | o | o | — | o | o | o | 7 | 181 | 150 | x |
| $C_1$-2 | (Comp.) | o | o | — | o | x | o | 7 | 175 | 152 | x |

*Before development
**After development

1) A process heat treatment:

(1) A process heat treating time

The heat treating time is preferably 0.1 hour or more. In $A_1$-1 which was treated for 0.1 hour or more, the curling habit is sufficiently small and a heel folding is not generated. Further, the endothermic amount also exceeds 100 mcal/g. Meanwhile, in $A_1$-2 which was treated for less than 0.1 hour, the curling habit is large and a heel folding is generated. The endothermic amount is less than 100 mcal/g.

As described above, the heat treatment requires 0.1 hour or more, and the endothermic amount of the endothermic peak including Tg, which is generated thereby, is required to be 100 mcal/g or more.

The heat treating time is preferably 1500 hours or less. The example in which the heat treatment was carried out for more than 1,500 hours was shown in $A_1$-4, and the curl value thereof is scarcely different from that of $A_1$-3 which was treated for 1,400 hours. Further, a large difference in the endothermic amount is not observed. Accordingly, the heat treatment for more than 1,500 hours and the heat treatment providing the endothermic amount exceeding 1,000 mcal/g provide a saturated effect for allowing a curl to be hard to form and are of an inferior efficiency.

As described above, then heat treating time is preferably 0.1 to 1,500 hours and the endothermic amount is preferably 100 to 1,000 mcal/g.

(2) A process heat treating temperature

The lower limit of the heat treating temperature is preferably 50° C. or higher. $A_1$-5 which was subjected to the heat treatment at a temperature lower than 50° C. easily forms a curling habit and generates a heel folding in spite of the heat treatment for 1,400 hours. Meanwhile, $A_1$-3 which was subjected to the heat treatment at 50° C. or higher is hard to form the curling habit and does not generate the heel folding.

Meanwhile, the upper limit of the heat treating temperature is preferably Tg. The limit exceeding Tg allows the curling habit to form easily and generates heel folding as shown in $A_1$-6. Meanwhile, $A_1$-1 which was subjected to the heat treatment at the temperature of Tg or lower does not cause a problem.

Thus, the heat treating temperature is preferably from Tg to 50° C.

(3) Preheat treating temperature

The lower limit temperature in the pre-heat treatment is Tg. If the treatment is carried out at the temperature lower than this, an improvement in the curling habit is scarcely observed as compared with $A_1$-7 which was not subjected to the heat treatment as shown in $A_1$-8. Meanwhile, in $A_1$-9 in which the limit exceeds Tg, the curling habit is hard to form even by the treatment for a short time as compared with $A_1$-7.

Meanwhile, the upper limit temperature is Tg+130° C. In $A_1$-12 which was treated at the temperature exceeding this, the elastic modulus of a base was lowered and a handling property was no good. Meanwhile, in $A_1$-13 which was subjected to the heat treatment at this temperature or lower, such trouble was not generated.

Accordingly, the pre-heat treating temperature is preferably from Tg to (Tg+130° C.).

(4) Pre-heat treating time

The lower limit of a pre-heat treating time is 0.1 minute. As shown in $A_1$-14, a shorter treating time scarcely provides any effect for reducing a curling habit as compared with $A_1$-7. Meanwhile, in $A_1$-13 which was treated for a longer time than this, the curling habit is reduced as compared with $A_1$-7 and the effect can be confirmed.

Meanwhile, an upper limit time is 1,500 hours (that is, 90,000 minutes). $A_1$-11 was subjected to the heat treatment over this time. Coloring is generated since the heat treatment was carried out over such a long period of time. Meanwhile, in $A_1$-1 which was subjected to the heat treatment for less than this time, this trouble is not generated.

Accordingly, the pre-heat treating time is preferably from 0.1 minute to 1500 hours.

(5) Water content

The water content is preferably 0.2% or more. The example in which the water content is lower than this value was shown in $A_1$-15. On the contrary, $A_1$-16 having the water content of 0.2% or more is hard to get into a curling habit.

The upper limit of the water content is 5%. $A_1$-18 having the water content exceeding this has a large shrinkage after the heat treatment and is no good. Meanwhile, $A_1$-17 having the water content less than 5% resides at an acceptable level in the amount of shrinkage.

Thus, the water content is preferably from 0.2% to 5%.

(6) Heat treatment process (high temperature rolling process and transporting and transporting heat treating process)

Such the heat treating processes may be carried out during the transportation of a base or may be carried out in the condition of the rolled bulk of the base heated to a high temperature. $A_1$-1 to $A_1$-18 which have so far been shown to produce the results obtained by the high temperature rolling process. The results obtained according to the transporting heat treating process are shown in $A_1$-19 to $A_1$-20, and they provide a sufficient effect to make a curling habit hard to form as is the case with the high temperature rolling process.

(7) Spool size

The photographic material subjected the heat treatment is rolled preferably on a spool with the diameter of 5mm or more. The spool smaller than this generates a pressure fog as shown in $A_1$-21. The spool of 5 mm does not generate a problem as is the case with $A_1$-22.

Meanwhile, the upper limit is preferably 11 mm. In the case where this is exceeded, the trouble of a heel folding is not generated even if the heat treatment of the present invention is not provided as shown in $A_1$-25. Meanwhile, the spool of 11 mm causes the heel folding as shown in $A_1$-24 if the heat treatment of the present invention is not carried out.

Thus, the spool has preferably the diameter of 5 to 11 mm.

(8) Comparison with the case in which heating is applied from a room temperature in a roll condition There is shown in $A_1$-26, the case in which heating is applied from a room temperature in a roll condition to provide the heat treatment. In this process, an irregularity is generated and a face condition is very bad. On the contrary, in those for which the present invention was enforced, for example, $A_1$-1, such trouble is not generated and it is shown that the present invention is an effective means.

8-2) B process heat treatment:

(1) Cooling speed

A cooling speed in Tg to (Tg-40° C.) is preferably −20° C./minute or less. The cooling speed more than this forms a strong curling habit and generates a heel folding. Also, the endothermic amount of an endothermic peak which appears including Tg is 100 mcal/g or less. On the contrary, $A_1$-102 in which the cooling speed is −20° C./minute or less forms the small curling habit, does not generate the heel folding and provides the endothermic amount exceeding 100 mcal/g.

Meanwhile, the cooling speed is preferably −0.01° C./minute or more. The example in which cooling was carried out at −0.005° C./minute was shown in $A_1$-104 as the example slower than this. The endothermic amount in this example is less than 1000 mcal/g. The example in which cooling was carried out at 0.02° C./minute was shown in A,103 as the example faster than this. The endothermic amount in this example exceeds 1000 mcal/g. Both show almost the same curling habit, and it is shown that cooling more slowly than −0.01° C./minute does not change the value of the curling habit.

As shown above, the cooling speed is preferably 20° to 0.01° C./minute. The endothermic amount of the endothermic peak which appears including Tg is preferably 100 to 1,000 mcal/g.

(2) Preheat treatment

Similarly to the case of the A process heat treatment, preferred are the lower limit temperature of Tg, the upper limit temperature of Tg+130° C., and the treating time of 0.1 minute to 1,500 hours. These experimental results are apparent from the comparisons of $A_1$-106 with $A_1$-107, $A_1$-110 with $A_1$-111, $A_1$-111 with. $A_1$-112, and $A_1$-108 with $A_1$-109, respectively.

(3) Steam treatment

Similarly to the A process heat treatment, a water content is preferably from 0.2% to 5%. This is apparent from the comparisons of $A_1$-113 with $A_1$-114 and $A_1$-115 with $A_1$-116, respectively.

(4) High temperature rolling process and transporting heat treating process

The results obtained with the transporting heat treating process are shown in $A_1$-101 to $A_1$-116. Also in the high temperature rolling process, the good results are obtained as shown in $A_1$-117 with $A_1$-118.

(5) Base film thickness

A base thickness is preferably 60 μm or more. In $A_1$-121 having the thickness of 50 μm or less, the strength of the base is short and a gutter-form curl is generated. Meanwhile, in $A_1$-120 having the thickness of 70 μm, the curl is not generated. As shown above, the base thickness is preferably 60 μm or more.

Meanwhile, in a TAC support, the gutter-form curl is not generated with 122 μm as shown in $C_1$-1 but the gutter-form curl is generated with 110 μm as shown in $C_1$-2. That is, the thickness of more than 122 μm can be achieved also in TAC and the effect of the present invention is not given.

Accordingly, the base thickness is preferably from 60 to 122 μm.

(6) Comparison with PET

The example in which PET is used is shown in $B_1$-1. Since PET has as low Tg as 69° C., a temperature exceeding Tg provided a core set at 80° C. though the heat treatment corresponding to the present invention was provided. Accordingly, these effects are canceled and a very strong curling habit was generated. As described above, Tg of a base is preferably 90° C. or higher.

Example 1-2

1) Preparation of the samples:

The blend of polyesters with different Tg used for a support was prepared by drying in advance the pellets of PEN, PET, PAr, PCT, and polycarbonate (PC) at 130° C. for 4 hours under vacuum and then kneading and extruding them with a biaxial kneading extruder at 300° C. in a mixing ratio shown in Table 5, followed by pelletizing.

This polyester was subjected to a film formation in the same manner as that in PEN of Example 1-1. Tg of the films thus prepared showed 73° to 123° C. as shown in Table 5. Further, they were coated with a subbing layer and a back layer according to the procedure of PEN in Example 1-1. Thereafter, the heat treatment was carried out at the conditions shown in Table 5. The heat treatment was carried out while rolling a support with the width of 1400 mm and the length of 1000 m on a roll with the diameter of 30 cm.

2) Evaluation of the samples:

A photographic material comprising a base and provided thereon the light-sensitive layers was evaluated in the same manner as that in Example 1-1.

3) Results:

The results are shown in Table 5 below.

TABLE 5

| Sample | Support blend ratio* wt % | Thickness μm | Tg °C. | Preheat treatment Temp. °C. | Preheat treatment Time min | Preheat treatment Process** | A process heat treatment Temp. °C. | A process heat treatment Time min | A process heat treatment Process** | B process heat treatment Cooling speed*** °C./min | B process heat treatment Process** | Steam treatment Temp. °C. | Steam treatment Time min | Steam treatment Water content % |
|---|---|---|---|---|---|---|---|---|---|---|---|---|---|---|
| $D_1$-1 | 100/0/0/0/0 | 85 | 119 | 150 | 5 | Tran | 110 | 16 | High | — | — | — | — | — |
| $D_1$-2 | 70/30/0/0/0 | 85 | 99 | 130 | 5 | Tran | 90 | 16 | High | — | — | — | — | — |
| $D_1$-3 | 40/60/0/0/0 | 85 | 91 | 120 | 5 | Tran | 80 | 16 | High | — | — | — | — | — |
| $D_1$-4 | 25/75/0/0/0 | 85 | 83 | 110 | 5 | Tran | 70 | 16 | High | — | — | — | — | — |
| $D_1$-5 | 0/0/50/50/0 | 85 | 118 | 150 | 5 | Tran | 110 | 16 | High | — | — | — | — | — |
| $D_1$-6 | 80/0/0/0/20 | 85 | 125 | 160 | 5 | Tran | 115 | 16 | High | — | — | — | — | — |
| $D_1$-7 | 100/0/0/0/0 | 85 | 119 | 150 | 5 | Tran | — | — | — | 2 | Tran | — | — | — |
| $D_1$-8 | 70/30/0/0/0 | 85 | 99 | 130 | 5 | Tran | — | — | — | 2 | Tran | — | — | — |
| $D_1$-9 | 40/60/0/0/0 | 85 | 91 | 120 | 5 | Tran | — | — | — | 2 | Tran | — | — | — |
| $D_1$-10 | 25/75/0/0/0 | 85 | 83 | 110 | 5 | Tran | — | — | — | 2 | Tran | — | — | — |
| $D_1$-11 | 0/0/50/50/0 | 85 | 118 | 150 | 5 | Tran | — | — | — | 2 | Tran | — | — | — |
| $D_1$-12 | 80/0/0/0/20 | 85 | 125 | 160 | 5 | Tran | — | — | — | 2 | Tran | — | — | — |
| $D_1$-13 | 70/30/0/0/0 | 85 | 99 | 130 | 5 | Tran | 110 | 16 | High | — | — | 90 | 5 | 1.2 |
| $D_1$-14 | 70/30/0/0/0 | 85 | 99 | 130 | 5 | Tran | — | — | — | 2 | Tran | 90 | 5 | 1.2 |

*PEN/PET/PAr/PCT/PC.
**Tran: transporting heat treating process.
High: high temperature rolling process.
***average cooling speed between Tg to Tg −40° C., °C./minute.

| Sample | | Endothermic amount mcal/g | Handling property | Face condition | Shrinkage | Coloring | Gutter-form curl | Curling habit Core size mm | Curling habit Curl* | Curling habit Curl** | Heel folding |
|---|---|---|---|---|---|---|---|---|---|---|---|
| $D_1$-1 | (Inv.) | 390 | o | o | o | o | o | 7 | 72 | 45 | o |
| $D_1$-2 | (Inv.) | 360 | o | o | o | o | o | 7 | 74 | 46 | o |
| $D_1$-3 | (Inv.) | 350 | o | o | o | o | o | 7 | 80 | 49 | o |
| $D_1$-4 | (Comp.) | 30 | o | o | o | o | o | 7 | 105 | 72 | x |
| $D_1$-5 | (Inv.) | 410 | o | o | o | o | o | 7 | 71 | 43 | o |
| $D_1$-6 | (Inv.) | 380 | o | o | o | o | o | 7 | 75 | 45 | o |
| $D_1$-7 | (Inv.) | 380 | o | o | o | o | o | 7 | 80 | 47 | o |
| $D_1$-8 | (Inv.) | 370 | o | o | o | o | o | 7 | 81 | 48 | o |
| $D_1$-9 | (Inv.) | 350 | o | o | o | o | o | 7 | 82 | 48 | o |
| $D_1$-10 | (Comp. | 20 | o | o | o | o | o | 7 | 110 | 75 | x |
| $D_1$-11 | (Inv.) | 390 | o | o | o | o | o | 7 | 76 | 45 | o |
| $D_1$-12 | (Inv.) | 400 | o | o | o | o | o | 7 | 78 | 46 | o |
| $D_1$-13 | (Inv.) | 400 | o | o | o | o | o | 7 | 72 | 40 | o |
| $D_1$-14 | (Inv.) | 430 | o | o | o | o | o | 7 | 77 | 42 | o |

*Endothermic amount in an endothermic peak including Tg.
**Before development.
***After development.

There were shown in $D_1$-1 to $D_1$-6, the examples in which the A process heat treatment and the preheat treatment were conducted, and in $D_1$-7 to $D_1$-12, the examples in which the B process heat treatment and the pre-heat treatment were conducted. In any cases, a curling habit is sufficiently reduced and a heel folding is not generated, except for $D_1$-4 and $D_1$-10 which each have a Tg lower than 90° C. It can be found that the present invention is effective as well in a polymer blend having Tg of 90° C. or higher.

Further, the examples in which the A process heat treatment and the B process heat treatment were combined with the steam treatment were shown in $D_1$-13 and $D_1$-14. These treatments effectively work as well in such polymer blend and show a small curling habit as compared with $D_{21}$-2 and $D_1$-8.

Example 1-3

1) Preparation of the light-sensitive material:

Polyester having the glass transition temperature of 90° C. or higher was prepared by a polycondensation according to a transesterification process in an autoclave made of a stainless steel, wherein there were mixed, dimethyl terephthalate (TPDM) and a dimethyl 2,6-naphthalenedicarboxylate (NDCA) as dicarboxylic acid: and ethylene glycol (EG), bisphenol A (BPA) and cyclohexanedimethanol (CHDM) as diol in the composition shown in Table 6, and antimony trioxide 0.025 mole (based on an acid component) was used as a catalyst.

Polyester thus synthesized was subjected to a film formation in the same manner as that in PEN of Example 1-1. Further, this was coated with a subbing layer and a back layer according to the procedure of Example 1-1, and then the heat treatment was carried out. The heat treatment was carried out while rolling lo a support with the width of 1400 mm and the length of 1000 m on a roll with the diameter of 30 cm.

2) Evaluation of the samples:

A photographic material comprising a base and provided thereon the light-sensitive layers was evaluated in the same manner as that in Example 1-1.

3) Results:

The results are shown in Table 6.

TABLE 6

| Sample | Support blend ratio* wt % | Thickness μm | Tg °C. | Preheat treatment Temp. °C. | Time min | Process** | A process heat treatment Temp. °C. | Time min | Process** | B process heat treatment Cooling speed*** °C./min | Process** | Steam treatment Temp. °C. | Time min | Water content % |
|---|---|---|---|---|---|---|---|---|---|---|---|---|---|---|
| $E_1$-1 | 60/40/100/0/0 | 85 | 103 | 135 | 5 | Tran | 193 | 16 | High | — | — | — | — | — |
| $E_1$-2 | 40/60/100/0/0 | 85 | 92 | 120 | 5 | Tran | 82 | 16 | High | — | — | — | — | — |
| $E_1$-3 | 35/65/100/0/0 | 85 | 87 | 120 | 5 | Tran | 77 | 16 | High | — | — | — | — | — |
| $E_1$-4 | 25/75/100/0/0 | 85 | 77 | 110 | 5 | Tran | 67 | 16 | High | — | — | — | — | — |
| $E_1$-5 | 0/100/25/25/50 | 85 | 115 | 145 | 5 | Tran | 105 | 16 | High | — | — | — | — | — |
| $E_1$-6 | 60/40/100/0/0 | 85 | 103 | 130 | 5 | Tran | — | — | — | 2 | Tran | — | — | — |
| $E_1$-7 | 40/60/100/0/0 | 85 | 92 | 120 | 5 | Tran | — | — | — | 2 | Tran | — | — | — |
| $E_1$-8 | 35/65/100/0/0 | 85 | 87 | 120 | 5 | Tran | — | — | — | 2 | Tran | — | — | — |
| $E_1$-9 | 25/75/100/0/0 | 85 | 77 | 110 | 5 | Tran | — | — | — | 2 | Tran | — | — | — |
| $E_1$-10 | 0/100/25/25/50 | 85 | 115 | 145 | 5 | Tran | — | — | — | 2 | Tran | — | — | — |
| $E_1$-11 | 0/100/25/25/50 | 85 | 115 | 145 | 5 | Tran | 105 | 16 | High | — | — | 100 | 5 | 1.3 |
| $E_1$-12 | 0/100/25/25/50 | 85 | 115 | 145 | 5 | Tran | — | — | — | 2 | Tran | 100 | 5 | 1.3 |

*MDCDM/TPDM/EG/CHDM/BPA.
**Tran: transporting heat treating process.
High: high temperature rolling process.
***Average cooling speed between Tg and Tg −40° C.

| Sample | | Endothermic amount mcal/g | Handling property | Face condition | Shrinkage | Coloring | Gutter-form curl | Curling habit Core size mm | Curl* | Curl** | Heel folding |
|---|---|---|---|---|---|---|---|---|---|---|---|
| $E_1$-1 | (Inv.) | 290 | o | o | o | o | o | 7 | 86 | 55 | o |
| $E_1$-2 | (Inv.) | 280 | o | o | o | o | o | 7 | 87 | 57 | o |
| $E_1$-3 | (Comp.) | 40 | o | o | o | o | o | 7 | 122 | 89 | x |
| $E_1$-4 | (Comp.) | 20 | o | o | o | o | o | 7 | 190 | 155 | x |
| $E_1$-5 | (Inv.) | 310 | o | o | o | o | o | 7 | 77 | 50 | o |
| $E_1$-6 | (Inv.) | 280 | o | o | o | o | o | 7 | 89 | 56 | o |
| $E_1$-7 | (Inv.) | 260 | o | o | o | o | o | 7 | 91 | 57 | o |
| $E_1$-8 | (Comp.) | 30 | o | o | o | o | o | 7 | 155 | 122 | x |
| $E_1$-9 | (Comp.) | 20 | o | o | o | o | o | 7 | 215 | 180 | x |
| $E_1$-10 | (Inv. | 300 | o | o | o | o | o | 7 | 83 | 52 | o |
| $E_1$-11 | (Inv.) | 350 | o | o | o | o | o | 7 | 77 | 45 | o |
| $E_1$-12 | (Inv.) | 340 | o | o | o | o | o | 7 | 79 | 43 | o |

*Endothermic amount in an endothermic peak including Tg.
**Before development.
***After development.

There were shown in $E_1$-1 to $E_1$-5, the examples in which the A process heat treatment and the pre-heat treatment were conducted, and in $E_1$-6 to $E_1$-10, the examples in which the B process heat treatment was combined with the pre-heat treatment. In any cases, a curling habit is sufficiently reduced in $E_1$-1, $E_1$-2 and $E_1$-5, and $E_1$-6, $E_1$-7 and $E_1$-10 each having Tg exceeding 90° C. On the contrary, in $E_1$-3 and 4, and $E_1$-8 and 9 each having Tg of 90° C. or lower, the curling habit shows a large value and a heel folding is generated.

Further, there were shown in $A_1$-11 and $A_1$-12, the examples in which the A process heat treatment and the pre-heat treatment, and the B process heat treatment and the pre-heat treatment were combined with the steam treatment, respectively. Thus, it can be found that the curling habit becomes small as well in such the copolymer base as compared with $A_1$-1 and $A_1$-6 by adding the steam treatment.

As described above, it is shown that the present invention is effective as well in a copolymerized polyester series as long as Tg is 90° C. or higher.

Example 2-1

1) Preparation of the support:

The following supports $A_2$ to $C_2$ were prepared according to the processes described below.

Support A2 (polyethylene naphthalate (PEN) thickness 55 μm, 65 μm and 90 μm),

Support B2 (the same as Support B, of Example 1-1),

Support C2 (the same as Support C, of Example

Support A2

After commercially available polyethylene-2,6-p naphthalate polymer 100 parts by weight and Tinuvin P 326 (manufactured by Geigy To., Ltd.) 2 parts by weight as a UV absorber were dried in an ordinary manner, they were melted at 300° C. and then subjected to a longitudinal orientation, a lateral orientation and a heat fixation at the conditions shown in Table 7, whereby the films with the thicknesses of 55 μm, 65 μm and 90 μm were obtained.

2) Heat treatment of the supports:

The supports $A_2$ and $B_2$ were subjected to a heat treatment after the same surface treatment as that in Example 1-1 in order to lower a curling habit. All supports of $A_2$ except $A_2$-2 were wound on a roll core with a face on which an emulsion is to be coated outside and subjected to a heat treatment at 110° C. for 24 hours. Only $A_2$-2 was subjected to the heat treatment by slowly cooling from the temperature of Tg or higher, that is, 130° C. to 110° C. over a period of 2 hours.

Further, the supports $B_2$ were wound as well on a roll core having the diameter of 30 cm with an emulsion-coated face outside and subjected to a heat treatment at Tg or lower, that is, 60° C. for 72 hours.

Coating of a subbing layer;

The following subbing solution was coated on the supports $A_2$ and $B_2$ in the amount of 10 ml/m$^2$ and dried at 110° C. for 2 minutes.

| | |
|---|---|
| Gelatin | 1 part |
| Distilled water | 1 part |
| Acetic acid | 1 part |
| Methanol | 50 parts |
| Ethylene dichloride | 50 parts |
| p-Chlorophenol | 4 parts |

The subbing solution of the following composition was coated on the support $C_2$, in the amount of 20 ml/m$^2$ and dried at 90° C. for 3 minutes.

| | |
|---|---|
| Gelatin | 275 parts |
| Formaldehyde | 12.1 parts |
| Salicylic acid | 82.4 parts |
| Methanol | 4372 parts |
| Methylene chloride | 22200 parts |
| Acetone | 31000 parts |
| Distilled water | 626 parts |

The back layer was coated on the sides opposite to the sides of the supports $A_2$ to $C_2$ in the same manner as Example 1-1.

5) Evaluation of the supports:

The supports which finished the provision of up to a subbing layer and a back layer were subjected to the following evaluations according to the processes described previously.

(a) Tg and endothermic amount at Tg

A subbing face and a back face were scraped off with a razor, and then a measurement was carried out with DSC.

(b) Crystallinity

A subbing face and a back face were scraped off with a razor, and then a measurement was carried out with a density gradient tube.

(c) tan δ:

In the state that the subbing and back layers were still remained, a measurement was carried out with REO VIBRON (manufactured by Toyo Boardwin Co., Ltd. ).

(d) Young's modulus and breaking elongation

In the state that the subbing and back layers were still remained, a measurement was carried out with a tensile tester.

(e) Refraction index ratio

Before coating a back layer and a subbing layer and after a UV ray treatment and a heat treatment, a measurement was carried out with an Abbe's refractometer.

6) Coating of the light-sensitive layers:

The light-sensitive layers were coated in the same manner as those in Example 1-1 to prepare the lightsensitive materials $A_2$-1 to $A_2$-21, $B_2$-11 and $C_2$-1 to $C_2$-2.

7) Evaluation of a film having an emulsion thereon:

7-1) Evaluation of a curling habit and Gutter-form curl:

They were evaluated in the same manner as those in Example 1-1.

7-2) Hole boring performance:

The hole boring equipment shown in the examples of JP-A-1-210299 was used to carry out a hole boring on these films. The hole boring was made at the both ends of the film according to the process of a 135 system. After boring the hole by 100 m, the hole boring performance was judged by the generation state of chips and the generation condition of "whiskers" at boring portion. With the sample ($B_2$-1) of PET set as a standard, those having more chips generated or more "whiskers" than this were represented by x; those equivalent to or less than PET by o; and those a little inferior to PET but falling within a tolerance by Δ.

8) Results:

The results are shown in Table 7 below.

TABLE 7

| Sample | Support | Thickness μm | Orientation magnification Long* | Orientation magnification Lat** | Heat fixing Temp. °C. | Heat fixing Time sec. | Heat treatment | Tg °C. | Endothermic amount at Tg mcal/g | tan δ | Crystallinity |
|---|---|---|---|---|---|---|---|---|---|---|---|
| $A_2$-1 | PEN | 85 | 3.5 | 3.8 | 250 | 6.0 | 110° C. 24 hr | 119 | 320 | 0.020 | 0.41 |
| $A_2$-2 | PEN | 85 | 3.5 | 3.8 | 250 | 6.0 | 130 to 100° C. slowly cooling for 2 hr | 119 | 300 | 0.021 | 0.40 |
| $A_2$-3 | PEN | 85 | 3.5 | 3.8 | 250 | 6.0 | 110° C. 6 hr | 119 | 90 | 0.025 | 0.41 |
| $A_2$-4 | PEN | 85 | 3.5 | 3.8 | 250 | 6.0 | 110° C. 8 hr | 119 | 110 | 0.024 | 0.41 |
| $A_2$-5 | PEN | 85 | 3.5 | 3.8 | 250 | 6.0 | 110° C. 400 hr | 119 | 1100 | 0.012 | 0.41 |
| $A_2$-6 | PEN | 85 | 3.5 | 3.8 | 250 | 6.0 | 110° C. 200 hr | 119 | 900 | 0.013 | 0.41 |

TABLE 7-continued

| | | | | | | | | | | | |
|---|---|---|---|---|---|---|---|---|---|---|---|
| $A_2$-7 | PEN | 85 | 4.0 | 4.5 | 250 | 6.0 | 110° C. 24 hr | 119 | 300 | 0.018 | 0.44 |
| $A_2$-8 | PEN | 85 | 3.8 | 4.0 | 250 | 6.0 | 110° C. 24 hr | 119 | 310 | 0.017 | 0.43 |
| $A_2$-9 | PEN | 85 | 2.8 | 3.2 | 250 | 6.0 | 110° C. 24 hr | 119 | 345 | 0.025 | 0.36 |
| $A_2$-10 | PEN | 85 | 3.2 | 3.4 | 250 | 6.0 | 110° C. 24 hr | 119 | 335 | 0.023 | 0.37 |
| $A_2$-11 | PEN | 85 | 3.5 | 3.8 | 250 | 200.0 | 110° C. 24 hr | 119 | 280 | 0.016 | 0.51 |
| $A_2$-12 | PEN | 85 | 3.5 | 3.8 | 250 | 16.0 | 110° C. 24 hr | 119 | 290 | 0.017 | 0.48 |
| $A_2$-13 | PEN | 85 | 3.5 | 3.8 | 250 | 1.0 | 110° C. 24 hr | 119 | 340 | 0.025 | 0.28 |
| $A_2$-14 | PEN | 85 | 3.5 | 3.8 | 250 | 3.0 | 110° C. 24 hr | 119 | 330 | 0.024 | 0.32 |
| $A_2$-15 | PEN | 85 | 3.5 | 3.8 | 250 | 6.0 | 110° C. 24 hr | 119 | 320 | 0.020 | 0.41 |
| $A_2$-16 | PEN | 85 | 3.5 | 3.8 | 250 | 6.0 | 110° C. 24 hr | 119 | 320 | 0.020 | 0.41 |
| $A_2$-17 | PEN | 85 | 3.5 | 3.8 | 250 | 6.0 | None | 119 | 0 | 0.030 | 0.41 |
| $A_2$-18 | PEN | 85 | 3.5 | 3.8 | 250 | 6.0 | None | 119 | 0 | 0.030 | 0.41 |
| $A_2$-19 | PEN | 85 | 3.5 | 3.8 | 250 | 6.0 | 110° C. 24 hr | 119 | 320 | 0.020 | 0.41 |
| $A_2$-20 | PEN | 55 | 3.5 | 3.8 | 250 | 6.0 | 110° C. 24 hr | 119 | 315 | 0.021 | 0.42 |
| $A_2$-21 | PEN | 65 | 3.5 | 3.8 | 250 | 6.0 | 110° C. 24 hr | 119 | 320 | 0.022 | 0.42 |
| $B_2$-1 | PET | 90 | 3.5 | 3.8 | 200 | 4.0 | 60° C. 72 hr | 69 | 280 | 0.006 | 0.55 |
| $C_2$-1 | TAC | 122 | — | — | — | — | — | 120 | — | 0.016 | — |
| $C_2$-2 | TAC | 110 | — | — | — | — | — | 120 | — | 0.016 | — |

| Sample | | Young's modulus kg/mm² | Breaking elongation % | Refraction index ratio | Core mm | Curling habit: Before developing | Curling habit: After developing | Curling habit: Heel folding | Hole boring property | Gutter-form curl |
|---|---|---|---|---|---|---|---|---|---|---|
| $A_2$-1 | (Inv.) | 620 | 130 | 1.15 | 7 | 85 | 48 | o | o | o |
| $A_2$-2 | (Inv.) | 615 | 135 | 1.13 | 7 | 86 | 50 | o | o | o |
| $A_2$-3 | (Comp.) | 570 | 160 | 1.16 | 7 | 110 | 75 | x | o | o |
| $A_2$-4 | (Inv.) | 580 | 150 | 1.16 | 7 | 95 | 62 | o | o | o |
| $A_2$-5 | (Comp.) | 750 | 55 | 1.13 | 7 | 70 | 34 | o | x | o |
| $A_2$-6 | (Inv.) | 720 | 65 | 1.14 | 7 | 71 | 35 | o | o | o |
| $A_2$-7 | (Comp.) | 680 | 55 | 1.23 | 7 | 85 | 52 | o | x | o |
| $A_2$-8 | (Inv.) | 660 | 95 | 1.21 | 7 | 83 | 50 | o | o | o |
| $A_2$-9 | (Comp.) | 520 | 215 | 1.08 | 7 | 81 | 46 | o | x | x |
| $A_2$-10 | (Inv.) | 540 | 200 | 1.12 | 7 | 82 | 48 | o | o | o |
| $A_2$-11 | (Comp.) | 630 | 95 | 1.18 | 7 | 84 | 51 | o | x | o |
| $A_2$-12 | (Inv.) | 625 | 100 | 1.17 | 7 | 83 | 52 | o | o | o |
| $A_2$-13 | (Comp.) | 520 | 170 | 1.15 | 7 | 82 | 48 | o | Δ | x |
| $A_2$-14 | (Inv.) | 550 | 150 | 1.14 | 7 | 83 | 50 | o | o | o |
| $A_2$-15 | (Comp.) | 620 | 170 | 1.15 | 4 | 200 | 89 | x | o | o |
| $A_2$-16 | (Inv.) | 620 | 170 | 1.15 | 5 | 150 | 69 | o | o | o |
| $A_2$-17 | (Comp.) | 530 | 130 | 1.17 | 12 | 145 | 66 | o | o | o |
| $A_2$-18 | (Comp.) | 530 | 130 | 1.17 | 11 | 155 | 75 | x | o | o |
| $A_2$-19 | (Inv.) | 620 | 170 | 1.17 | 11 | 65 | 30 | o | o | o |
| $A_2$-20 | (Comp. | 625 | 125 | 1.16 | 7 | 83 | 50 | o | o | x |
| $A_2$-21 | (Inv.) | 620 | 125 | 1.15 | 7 | 84 | 49 | o | o | o |
| $B_2$-1 | (Comp.) | 500 | 185 | 1.11 | 7 | 220 | 200 | x | Standard | o |
| $C_2$-1 | (Comp.) | 210 | 50 | 1.02 | 7 | 230 | 160 | x | — | Standard |
| $C_2$-2 | (Comp. | 210 | 50 | 1.02 | 7 | 230 | 150 | x | — | x |

*Long: Longitudinal.
**Lat: Lateral.

The examples of the present invention are shown in $A_2$-1 and $A_2$-2. $A_2$-1 is the case in which the heat treatment was carried out at a fixed temperature, and $A_2$-2 is the example in which the heat treatment was carried out while a sample was gradually cooled from the temperature of Tg or higher through Tg. In either cases, a curling habit, a hole boring performance, and a gutter-form curl are good.

In $A_2$-3 to $A_2$-6, a heat treating time was changed and an endothermic amount in Tg was varied. In $A_2$-3, the endothermic amount is 100 mcal/g or less, a curling habit is not sufficiently reduced, and a heel folding is generated at a mini lab. Meanwhile, in $A_2$-4 in which the endothermic amount exceeded 100 mcal/g, the curling habit is sufficiently lowered and a trouble is not generated at a mini lab.

In $A_2$-5, the endothermic amount exceeds 1,000 mcal/g, and the curling habit is sufficiently reduced but since this is accompanied with the reduction of a breaking elongation to 60% or less, chips are generated in boring a hole. Meanwhile, in $A_2$-6, the endothermic amount is 1000 mcal/g or less and the breaking elongation is 60% or more. Accordingly, there is no problem on boring a hole. Thus, the endothermic amount is preferably 100 mcal/g or more and 1000 mcal/g or less.

In $A_2$-7 to $A_2$-11, an orientation magnification was changed to form a film. In $A_2$-7, the orientation magnification was increased, whereby there were increased a Young's modulus to more than 670 kg/mm² and a refraction index ratio to more than 1.22. This makes a film fragile and lowers a hole boring performance. On the other hand, $A_2$-8 has the Young's modulus of 670 kg or less, the breaking elongation of 60% or more, and the refraction index ratio of 1.22 or less, and therefore the problem on the hole boring performance is not involved.

Meanwhile, $A_2$-9, in which the orientation magnification was reduced, has the Young's modulus of less than 530 kg/mm² the breaking elongation of more than 210%, and the refraction index ratio of less than 1.10. "Whiskers" at a hole boring portion are generated more than those of the PET film of a standard, and the hole boring performance was not acceptable. Further, a gutter-form curl was no good because of the reduction of a dynamic strength. On the other hand, $A_2$-10 has the Young's modulus of 530 kg/mm² or more, the breaking elongation of 210% or less, and the refraction index ration of 1.10 or more, and therefore no problem was involved in both the hole boring performance and gutter-form curl. Thus, the Young's modulus is preferably from 530 to 670 kg/mm$^2$, the breaking elongation is preferably from 60% to 200%, and the refraction index ratio is preferably from 1.10 to 1.22.

In $A_2$-11 to $A_2$-14, the heat fixing condition was changed. In $A_2$-11, the heat fixing was carried out for a long time to increase crystallinity, which exceeds 0.51. This is accompanied with the fragility of the film and an easier generation of boring chips, and therefore is a problem. On the contrary, there was no problem with the hole boring performance in $A_2$-12 having a crystallinity of 0.5 or less. Meanwhile, in $A_2$-13 in which the heat fixing was shortened to decrease the crystallinity to less than 0.3, the Young's modulus was reduced to less than 530 kg and 15 the gutter-form curl was increased. On the other hand, $A_2$-14 having a crystallinity of 0.3 or more did not have the problem of the gutter-form curl. Thus, the crystallinity is preferably from 0.3 to 0.5.

In $A_2$-15 to $A_2$-19, the size of the spool on which the film was rolled was changed. In $A_2$-15, a spool having a diameter of less than 5 mm was used. A pressure fog was generated on an emulsion layer with this spool, though it was not described in Table 7. On the contrary, $A_2$-16 in which the spool with a diameter of 5 mm was used did not generate pressure fog. Further, as shown in $A_2$-17 in which the spool with a diameter of 12 mm was used, even if the heat treatment was not carried out, that is, the endothermic amount of an endothermic peak including Tg was 0, the curling habit was sufficiently large and problems, such as heel folding, were not generated. Meanwhile, in $A_2$-18 and $A_2$-19 in which the spool with the diameter of 11 mm was used, the heel folding was not generated in $A_2$-19 to which the heat treatment of the present invention was provided. However, this heel folding was generated in $A_2$-18 in which the claimed heat treatment was not carried out. Thus, the film is preferably rolled on a spool with a diameter of 5 to 11 mm.

In $A_2$-20 and $A_2$-21, the film thickness was changed. Since $A_2$-20 has a film thickness of 60 μm or less and is short of dynamic strength, a gutter-form curl is generated and therefore a problem is involved. Meanwhile, $A_2$-21 has a film thickness of 60 μm or more and the gutter-form curl is not a problem. On the contrary, an existing color negative film uses a TAC support, and the TAC support has a thickness of 122 μm. Reducing this to 110 μm increases the gutter-form curl, which in turn lowers the performance in passing through a printer. Accordingly, the support of the present invention is superior to TAC when it is used in a thickness of 122 μm or less, and therefore the miniaturization of a patrone can be effectively achieved in this case. Accordingly, the support of the present invention is used preferably in the thickness of 60 to 122 μm.

The example of a PET support is shown in $B_2$-1. Since this support has Tg of less than 90° C., the curling habit is markedly formed by a core set at 80° C. for 2 hours, and processing problems are generated. Meanwhile, Tg of PEN exceeds 90° C., and the problem with the curling habit is not generated as shown in $A_2$-1 and $A_2$-2. Thus, Tg of the support is preferably 90° C. or higher.

As described above, the support of the present invention can be used to provide a photographic light-sensitive material having a small curling habit, an excellent dynamic strength and a superior hole boring performance.

Example 3-1

1) Preparation of the support:

The following supports $A_3$ to $C_3$ were prepared according to the processes described below:

Support $A_3$ (polyethylene naphthalate (PEN): thickness 55 μm, 65 μm and 85 μm), Support $B_3$ (polyethylene terephthalate (PET): thickness 90 μm), Support $C_3$ (triacetyl cellulose (TAC): thickness 122 μm).

Support $A_3$

Diaresin (manufactured by Mitsubishi Kasei Corporation) as a dye was mixed in a commercially available polyethylene-2,6-naphthalate polymer 100 parts by weight so that an absorbency in the thickness of 80 μm becomes 0.05 in 400 run, and the polymer was dried in an ordinary manner. The polymer was melted at 300° C. and then extruded from a T type die. It was subjected to a longitudinal orientation at 140° C. and subsequently to a lateral orientation at 130° C., followed by further subjecting it to a heat fixation at 250° C. for 6 seconds, whereby the films with a thickness of 85 μm were obtained, wherein there were prepared the films oriented at the magnifications of (a longitudinal orientation)×(a lateral orientation) of 2.2×2.0, 2.5×2.3, 3.2×3.0, 3.4×3.2, and 3.5×3.3 times, respectively. They are designated in order as $A_3$-1 to $A_3$-5. Further, those having the thicknesses of 55 and 65 μm after the heat fixation were prepared in the same orientation and heat fixing processes as those of $A_3$-4, and they were designated as $A_3$-6 and $A_3$-7.

Support $B_3$

Diaresin (manufactured by Mitsubishi Kasei Corporation) as a dye was mixed in a commercially available polyethylene terephthalate polymer 100 parts by weight so that an absorbency in the thickness of 80 μm becomes 0.05 in 400 nm, and the polymer was dried in an ordinary manner. The polymer was melted at 280° C. and then extruded from a T type die. It was subjected to a longitudinal orientation at 95° C. and subsequently to a lateral orientation at 90° C., followed by further subjecting it to a heat fixation at 230° C. for 6 seconds, whereby the films with the thickness of 90 μm were obtained, wherein there were prepared the films oriented at the magnifications of (a longitudinal orientation)×(a lateral orientation) of 2.3×2.1, 2.6×2.4, 3.2×3.0, 3.4×3.2, and 3.6×3.4 times, respectively, and they are designated in order as $B_3$-1 to $B_3$-5.

Support $C_3$

Triacetyl cellulose was dissolved in methylene chloride/methanol=8/2 ratio by weight in the TAC concentration of 13% using the plasticizers TPP/BDP=2/1 (wherein TPP: triphenyl phosphate and BDP: biphenyl diphenyl phosphate), and the solution was processed by a conventional solution flowing process to thereby prepare the supports by the band process of 15% by weight. The thickness after a film formation was 122 μm. The supports $A_3$ and $B_3$ thus prepared were subjected to the measurement of a birefringence by the method described above.

2) Heat treatment of the support:

The supports $A_3$ and $B_3$ which were subjected to a film formation and a surface-treatment by the above processes similarly to Example 1-1 were subjected to a heat treatment the processes shown in Table 8 during the coating of a subbing layer and a BC layer after the surface treatment.

3) Evaluation of the supports:

After these heat treatments, there were carried out the measurements of a stiffness and an endothermic amount in an endothermic peak which appears including Tg. The stiffness was measured with a loop stiffness tester (manufactured by Toyo Seiki Co., Ltd.) as a standard for a dynamic strength. This is a physical quantity corresponding to a bending elasticity (a deflection strength) and was measured in the following manner. An annulus ring is formed with the sample base having the width of 35 mm and the length of 100 mm and this is horizontally disposed. The weight-of a load necessary for pressing this annulus ring by 12 mm to deform it is measured. It is shown that the larger this value is, the larger the strength necessary for bending the base is, that is, the larger the bending elastic modulus is. This bending elastic modulus is one of the important physical properties for a support for a photographic film. The photographic film has a light-sensitive layer containing primarily gelatin which is a hygroscopic polymer on one side thereof. This gelatin is dehydrated in drying and markedly shrinks to generate a large shrinking stress. Meanwhile, since the support of a background does not shrink to such a large extent, it tries to relax the shrinking stress and deforms in a bow fored like a bimetal. Since the film thus deformed is of a large problem on handling, as little deformation as possible is preferred. Accordingly, the higher the bending elastic modulus of the support is (the stronger the stiffness is), the less this deforming quantity becomes and the more preferable. The target value of this stiffness is equivalent to or more than TAC 122 μm (Sample C). Those less than this are marked with x and those more than this with o.

The endothermic amount in an endothermic peak which appears including Tg was measured for the sample of 10 mg with a differential thermal analysis meter (DSC) while raising a temperature at 20° C./minute in a nitrogen stream.

The support thus prepared was checked for a curling habit. The support was cut to 35 mm×1250 mm and then wound on the spool shown in Table B. This was got into the curling habit at 60° C. for 2 hours or at 80° C. for 2 hours. After leaving it for cooling in the atmosphere of 25° C. for a night, it was subjected to a development processing (the developing conditions will be described later in detail) with a mini lab automatic developing machine (EP-550 β type manufactured by Fuji Photo Film Co., Ltd.), and then the curling habit was measured immediately after the processing. The curling habit is evaluated immediately after the mini lab processing for the following reason. A film support is recovered from the curling habit by water absorption and heat and finally passed through a nip roll disposed at an exit. The strong curling habit herein will cause the support to be squashed with the nip roll to result in generating "folding". Accordingly, the curling value immediately after the mini lab processing is important in evaluating the mini lab troubles.

The results obtained by evaluating in the above manners are shown in Table 8 below.

TABLE 8

| Sample | | Support | Tg °C. | Thickness μm | Birefringence | Stiffness* | Heat** treatment process | Heat*** amount mcal/g | Spool size mm | Curling habit of support 60° C./2 hr | Curling habit of support 80° C.2 hr |
|---|---|---|---|---|---|---|---|---|---|---|---|
| $A_3$-1-1 | (Comp.) | PEN | 119 | 85 | −0.08 | x | A | 410 | 7 | 31 | 40 |
| $A_3$-1-2 | (Comp.) | PEN | 119 | 85 | −0.08 | x | B | 390 | 7 | 32 | 42 |
| $A_3$-2-1 | (Inv.) | PEN | 119 | 85 | −0.12 | o | A | 330 | 7 | 35 | 45 |
| $A_3$-2-2 | (Inv.) | PEN | 119 | 85 | −0.12 | o | B | 270 | 7 | 39 | 52 |
| $A_3$-3-1 | (Inv.) | PEN | 119 | 85 | −0.21 | o | A | 290 | 7 | 37 | 50 |
| $A_3$-3-2 | (Inv.) | PEN | 119 | 85 | −0.21 | o | B | 270 | 7 | 39 | 52 |
| $A_3$-4-1 | (Inv.) | PEN | 119 | 85 | −0.29 | o | A | 200 | 7 | 41 | 57 |
| $A_3$-4-2 | (Inv.) | PEN | 119 | 85 | −0.29 | o | B | 180 | 7 | 42 | 59 |
| $A_3$-5-1 | (Comp.) | PEN | 119 | 85 | −0.31 | o | A | 90 | 7 | 63 | 87 |
| $A_3$-5-2 | (Comp.) | PEN | 119 | 85 | −0.31 | o | B | 80 | 7 | 64 | 89 |
| $A_3$-3-3 | (Comp.) | PEN | 119 | 85 | −0.21 | o | 110° C./1 hr | 80 | 7 | 65 | 87 |
| $A_3$-3-4 | (Inv.) | PEN | 119 | 85 | −0.21 | o | 110° C./2 hr | 120 | 7 | 55 | 0 |
| $A_3$-3-5 | (Inv.) | PEN | 119 | 85 | −0.21 | o | 110° C./5 days | 900 | 7 | 27 | 35 |
| $A_3$-3-6 | (Comp.) | PEN | 119 | 85 | −0.21 | o | 110° C./30 days | 1100 | 7 | 25 | 33 |
| $A_3$-3-7 | (Comp.) | PEN | 119 | 85 | −0.21 | o | 150° C./8 hr | **** | 7 | 63 | 85 |
| $A_3$-6 | (Comp.) | PEN | 119 | 55 | −0.21 | x | A | 290 | 7 | 36 | 51 |
| $A_3$-7 | (Inv.) | PEN | 119 | 65 | −0.21 | o | A | 280 | 7 | 38 | 50 |
| $A_3$-3-8 | (Inv.) | PEN | 119 | 85 | −0.21 | o | 110° C./6 days | 920 | 7 | 32 | 34 |
| $A_3$-3-9 | (Comp.) | PEN | 119 | 85 | −0.21 | o | 110° C./6 days | 930 | 7 | 32 | 32 |
| $B_3$-1 | (Comp.) | PET | 69 | 90 | −0.09 | x | A | 380 | 7 | 60 | 200 |
| $B_3$-2 | (Inv.) | PET | 69 | 90 | −0.11 | o | A | 300 | 7 | 65 | 210 |
| $B_3$-3 | (Inv.) | PET | 69 | 90 | −0.27 | o | A | 270 | 7 | 67 | 210 |
| $B_3$-4 | (Inv.) | PET | 69 | 90 | −0.29 | o | A | 160 | 7 | 69 | 220 |
| $B_3$-5 | (Comp.) | PET | 69 | 90 | −0.31 | o | A | 90 | 7 | 89 | 230 |
| $C_3$-1 | (Comp.) | TAC | 120 | 122 | — | Standard | — | — | 11 | 100 | 130 |
| $C_3$-2 | (Comp.) | TAC | 120 | 122 | — | Standard | — | — | 10 | 140 | 170 |

*Equivalent to or more than TAC 122 μm: o.
**A process heat treatment, 110° C./8 hours.
B process heat treatment: (1) Tg +40° C. + 10 minutes, (2) rapidly cooled to Tg +10° C., (3) cooled from Tg +°C. to Tg in 10 minutes, (4) cooled from Tg to Tg −5° C. in 50 minutes, (5) rapidly cooled to a room temperature.
***Heat amount in an endothewrmic peak including Tg.
****Do not appear including Tg.

| Sample | | Pressure fog | Curling habit after coating an emulsion: 60° C./2 hours, After* developing | 60° C./2 hours, Heel folding at mini lab | 80° C./2 hours, After* developing | 80° C./2 hours, Heel folding at mini lab |
|---|---|---|---|---|---|---|
| $A_3$-1-1 | (Comp) | o | 41 | o | 51 | o |
| $A_3$-1-2 | (Comp.) | o | 42 | o | 53 | o |
| $A_3$-2-1 | (Inv.) | o | 46 | o | 55 | o |
| $A_3$-2-2 | (Inv.) | o | 47 | o | 58 | o |

TABLE 8-continued

| | | | | | | |
|---|---|---|---|---|---|---|
| $A_3$-3-1 | (Inv.) | o | 47 | o | 61 | o |
| $A_3$-3-2 | (Inv.) | o | 49 | o | 62 | o |
| $A_3$-4-1 | (Inv.) | o | 52 | o | 68 | o |
| $A_3$-4-2 | (Inv.) | o | 52 | o | 69 | o |
| $A_3$-5-1 | (Comp.) | o | 73 | o | 97 | x |
| $A_3$-5-2 | (Comp.) | o | 74 | o | 100 | x |
| $A_3$-3-3 | (Comp.) | o | 76 | o | 98 | x |
| $A_3$-3-4 | (Inv.) | o | 65 | o | 79 | o |
| $A_3$-3-5 | (Inv.) | o | 37 | o | 45 | o |
| $A_3$-3-6 | (Comp.) | o | 35 | o | 42 | o |
| $A_3$-3-7 | (Comp.) | o | 72 | o | 95 | x |
| $A_3$-6 | (Comp.) | o | 76 | o | 61 | o |
| $A_3$-7 | (Inv.) | o | 78 | o | 61 | o |
| $A_3$-3-8 | (Inv.) | o | 56 | o | 77 | o |
| $A_3$-3-9 | (Comp.) | x | 62 | o | 81 | x |
| $B_3$-1 | (Comp.) | o | 70 | o | 215 | x |
| $B_3$-2 | (Inv.) | o | 75 | o | 220 | x |
| $B_3$-3 | (Inv.) | o | 78 | o | 230 | x |
| $B_3$-4 | (Inv.) | o | 79 | o | 230 | x |
| $B_3$-5 | (Comp.) | o | 83 | x | 240 | x |
| $C_3$-1 | (Comp.) | o | 115 | o | 145 | o |
| $C_3$-2 | (Comp.) | o | 150 | x | 180 | x |

*Curling habit.

First of all, the samples of the PEN supports will be described. The data regarding those having the different birefringence were shown in the samples of $A_3$-1-1 to $A_3$-5-2. The evaluations thereof were carried out by comparing them with the two processes of a fixed temperature heat treatment (the A process heat treatment) and a slow cooling heat treatment (the B process heat treatment).

In $A_3$-1-1 and $A_3$-1-2 each having a birefringence smaller than –0.10, the curling habit is small enough but the stiffness is short and they are not good. Meanwhile, in $A_3$-2-1 and $A_3$-2-2 each having the birefringence smaller than –0.10, both the stiffness and the curling habit are good. On the other hand, in $A_3$-5-1 and $A_3$-5-2 each having the birefringence smaller than –0.30, the curling habit becomes notably large as compared with those of $A_3$-4-1 and $A_3$-4-2 each having a value smaller than this value, and the coating of an emulsion (will be described later) generates folding to make them no good. Thus, the birefringence is preferably from –0.3 to –0.1.

Next, an endothermic amount in an endothermic peak which appears including Tg were studied. In $A_3$-3-4 in which this endothermic amount exceeds 1,000 mcal/g, the curling habit is small enough. Meanwhile, in $A_3$-3-5 having a value less than this, the curling habit becomes large, and the coating of an emulsion generates heel folding to make it no good (will be described later). Meanwhile, this value exceeding 1,000 mcal/g saturates the effect for allowing the curling habit to be hard to form, and the curling habit shown in $A_3$-3-5 subjected to the heat treatment at 110° C. for 5 days becomes scarcely different from that shown in $A_3$-3-6 subjected to the heat treatment at 110° C. for 30 days. Further, since $A_3$-3-7 which is subjected to the heat treatment at the temperature of Tg or higher, the endothermic peak does not appear at the place including Tg (appears at the place exceeding Tg and the endothermic amount therein is 200 mcal/g), and this markedly decreases the curling habit reducing effect. Thus, the endothermic peak including Tg with the endothermic amount of 100 to 1,000 mcal/g preferably appears in the heat treatment.

Further, experiments in which the thickness was changed were carried out. As shown in $A_3$-6, a thickness less than 60 μm makes the stiffness smaller than that of TAC 122 μm, and is anticipated to generate problems. Meanwhile, in the sample of $A_3$-7 having a thickness exceeding 60 μm, the stiffness is equivalent to or more than that of TAC 122 mm, and no problem is expected. However, a thickness of 122 μm or more cancels the merit in a patrone miniaturization attained by the thinning of a support as compared with TAC. Accordingly, the thickness of the support is preferably 60 to 122 μm.

Next, the effect with a PET support will be described. Those which were evaluated changing the birefringence of the PET support are samples $B_3$-1 to $B_3$-5. Also in this case, $B_3$-1 having a birefringence larger than –0.1 is short of the stiffness and is no good. Meanwhile, in any of the samples of $B_3$-2 to $B_3$-3 in which this value falls within the range of the present invention (–0.3 to –0.1), any of them have a strong curling habit because of the curling habit at 80° C. exceeding Tg of PET. However, neglecting this rare case, the curling habit becomes a sufficiently small value at the conditions of 60° C. and 2 hours. In the sample of $B_3$-5 in which the birefringence is less than –0.3, the strong curling habit is generated even at 60° C./2 hours. Accordingly, PET can sufficiently be used as a photographic support at the usual use conditions if it satisfies the ranges of the present invention.

TAC 122 μm which is used at present is shown in Samples $C_3$-1 and 2. $C_3$-1 wound on an existing spool with a diameter of 11 mm does not have a strong curling habit and the coating of an emulsion does not generate problems. However, developing trouble in the curling habit is generated with a spool having a diameter of 10 mm, and therefore it can be found that TAC cannot be used on a spool with a diameter less than 11 mm.

Coating of a subbing layer;

The subbing solution of the following composition was coated on these supports $A_3$ to $C_3$, in the amount of 10 ml/m$^2$ and dried at 115° C. for 2 minutes.

| | |
|---|---|
| Gelatin | 1 part |
| Distilled | 1 part |
| Acetic acid | 1 part |
| Methanol | 5 parts |
| Ethylene dichloride | 50 parts |
| p-Chlorophenol | 4 parts |

The subbing solution of the following composition was coated on the support $C_3$ in the amount of 20 ml/m$^2$ and dried at 90° C. for 3 minutes.

| | |
|---|---|
| Gelatin | 275 parts |
| Formaldehyde | 12.1 parts |
| Salicylic acid | 82.4 parts |
| Methanol | 4372 parts |
| Methylene chloride | 22200 parts |
| Acetone | 31000 parts |
| Distilled water | 626 parts |

6) Coating of a back layer:

A back layer was coated on the supports $A_3$ to $C_3$ in the same manner as that in Example 1-1.

7) Coating of the light-sensitive layers:

The light-sensitive layers were coated in the same manner as that in Example 1-1 to thereby prepare a photographic material.

8) Evaluation of the film coated thereon with an emulsion:

The evaluations on curling habit and pressure fog were carried out in the same manner as those in Example 1-1. The results thereof are shown in Table 8.

9) Evaluation results of the film coated thereon with an emulsion:

9-1) Evaluation of the PEN film:

(1) Birefringence, curling habit and stiffness

As described in the item of the evaluation of the supports, $A_3$-2-1 to $A_3$-4-2 each having a birefringence which falls within the range (from −0.3 to −0.1) of the present invention d not generate problems in any process of a fixed temperature heat treatment and a slow cooling heat treatment at the conditions of 60° C./2 hours and 80° C./2 hours. Meanwhile, $A_3$-5-1 to $A_3$-5-2 each having the range more than this generate the stiffness. Thus, the birefringence falling within the range of the present invention can allow the curling habit and the stiffness to coexist.

(2) Endothermic amount and curling habit

As described in the item of the evaluation of the supports, $A_3$-3-4 to $A_3$-3-5 each having the birefringence which falls within the range (the endothermic amount in an endothermic peak which appears including Tg: 100 to 1,000 mcal/g) of the present invention do not generate the problems attributable to development processing. However, $A_3$-3-3 having a value smaller than this generates trouble in development processing. The heat treatment exceeding this range will saturate the effect for reducing the curling habit and is inefficient. $A_3$-3-6 was subjected to the heat treatment for as much as 25 days longer than $A_3$-3-5 but the curling habits after development were not so different.

This heat treatment must be carried out so that an endothermic peak appears including Tg. This requires the heat treatment at Tg or lower. The heat treatment at a temperature exceeding Tg allows the endothermic peak to appear exceeding Tg, is liable to form a curling habit and generate developing trouble as shown in $A_3$-3-7. Thus, it is required in the present invention to provide the heat treatment so that the endothermic peak appears including Tg and set the endothermic amount thereof at 100 to 1,00 mcal/g.

(3) Curling habit and spool size

The spool size used in the present invention is suitably 5 to 11 mm. As shown in $A_3$-3-8, a spool with a diameter of 5 mm does not generate developing trouble but a spool with a diameter of 4 mm ($A_3$-3-9) generates developing trouble even with the heat treatment carried out at 110° C. for 6 days. Further, pressure fog is generated as well. The diameter of 11 mm or more is an existing spool size and provides little merit. Accordingly, the diameter of 5 to 11mm is preferred.

(4) Support thickness

As described in the item of the support evaluation, in the thickness of 55 μm ($A_3$-6), the stiffness does not reach that of TAC 122 μm and is no good. Meanwhile, in the thickness of 65 μm ($A_3$-7), the stiffness resides at almost the same level as that of TAC 122 μm. Accordingly, the support thickness is preferably from 60 to 122 μm which is the thickness of existing TAC.

8-2) Evaluation of the PET film:

The photographic film of the PET support was evaluated as well for a birefringence, a curling habit and a stiffness. Also in the PET support, $B_3$-2 to $B_3$-4 each having a birefringence falling within the range of the present invention (−0.3 to −0.1) do not generate curling trouble except in the case of the rare curling habit condition of 80° C./2 hours. Meanwhile, $B_3$-5 having a value less than this range generates a curling habit condition smaller to that of 60° C./2 hours. The sample of $B_3$-1 having the value more than this range is short of the stiffness. Thus, allowing the birefringence to fall within the range of the present invention can satisfy both of the curling habit and the stiffness.

8-3) Evaluation of the TAC film:

The TAC film does not generate trouble with a spool having the diameter of 11 mm as shown in $C_3$-1 but has trouble with a spool having a diameter of 10 mm. It is that the spool having a diameter of 10 mm or less can not be used as long as TAC film is used.

As described above, the use of the present invention could provide a support which efficiently allows a curling habit to be hard to form and having an excellent physical strength.

Example 4-1

1) Materials for a support:

The respective supports used in the present invention were prepared according to the processes described below.

a) PEN

After a commercially available polyethylene-2,6 naphthalate polymer 100 parts by weight and Tinuvin P 326 (manufactured by Geigy Co., Ltd.) 2 parts by weight as a UV absorber were dried in an ordinary manner, the polymer was melted at 300° C. and then extruded from a T type die. The film was subjected to a longitudinal orientation of 3.3 times at 140° C. and subsequently to a lateral orientation of 3.3 times at 130° C., followed by further subjecting it to a heat fixation at 250° C. for 6 seconds, whereby a PEN film was obtained.

b) PET

A commercially available polyethylene terephthalate polymer was subjected to a biaxial orientation and a heat fixation according to the conventional processes to thereby obtain a PET film.

c) TAC

Triacetyl cellulose was dissolved in methylene chloride/methanol=8/2 ratio by weight in the TAC concentration of 13% using the plasticizers TPP/BDP=2/1 (wherein TPP: triphenyl phosphate and BDP: biphenyl diphenyl phosphate), and the solution was processed by a conventional solution flowing process to thereby prepare a TAC film by the band process of 15% by weight.

d) PEN/PET=4/1 (weight ratio)

After the pellets of PEN and, PET were dried in advance at 150° C. for 4 hours under vacuum, the polymer was kneaded and extruded with a biaxial kneading extruder at 280° C. and then was pelletized. This polyester was subjected to a film formation at the same conditions as those for PEN.

2) Coating of a subbing layer:

The respective supports described above were subjected on both sides thereof to a corona discharge treatment, a UV discharge treatment, and further a glow discharge treatment, and then the subbing solution of the following composition was coated thereon to thereby provide a subbing layer on an orienting high temperature face side. The corona discharge treatment was carried out with a solid state corona treating equipment 6 kVA model manufactured by Pillar Co., Ltd. to treat the support with the width of 30 cm at 20 m/minute, whereby the substance to be treated was found from the read values of a currency and a voltage to be subjected to the treatment of 0.375 KV.A. minute/$m^2$. A discharge frequency in the treatment was 9.6 kHz and a gap clearance between an electrode and a dielectric roll was 1.6 mm.

| | |
|---|---|
| Gelatin | 3 g |
| Distilled water | 25 ml |
| Sodium α-sulfo-di-2-ethylhexyl succinate | 0.05 g |
| Formaldehyde | 0.02 g |
| Salicylic acid | 0.1 g |
| Diacetyl cellulose | 0.5 g |
| p-Chlorophenol | 0.5 g |
| Resorcin | 0.5 g |
| Cresol | 0.5 g |
| $(CH_2{=}CHSO_2CH_2CH_2NHCO)_2CH_2$ | 0.2 g |
| Trimethylolpropane triazine | 0.2 g |
| Trimethylolpropane tritoluenediisocyanate | 0.2 g |
| Methanol | 15 ml |
| Acetone | 85 ml |
| Formaldehyde | 0.01 g |

3) Coating of the back layer and coating of the light-sensitive layers:

Coating of the back layer and coating of the light-sensitive layers were coated in the same manner as those in Example 1-1.

4) Processing of the photographic film sample:

The photographic film sample thus prepared was slit to the width of 35 mm and holes were bored. Then, it was built in a 135 standard cartridge and loaded in a 35 mm film cartridge.

5) Core set: The above cartridge was heated at 40° C. for 24 hours to form a curling habit. This temperature condition is based on the assumption of an outdoor summer season.

6) Tongue end of the film pulling out, development processing and curl measurement:

The above cartridge which got into the curling habit was left cooling in a 25° C. room for a night, and then it was subjected to a tongue pulling out with a tool. This was subjected to a development processing with an automatic developing machine (Mini Lab FP-550B: manufactured by Fuji Photo Film Co., Ltd) and immediately to a curl measurement at 25° C. and 60% RH.

7) Results:

The above results are shown in Table 9 below.

TABLE 9

| | Support | | | Film frame | Heat | Tongue end | | |
|---|---|---|---|---|---|---|---|---|
| Sample No. | Kind | Thickness μm | Tg °C. | number sheet | treatment °C./hrs | pulling out operation | Developing unevenness | Heel folding |
| 1 (Comp.) | TAC | 122 | 120 | 39 | None | Difficult | None | None |
| 2 (Comp.) | TAC | 105 | 120 | 45 | None | Difficult | None | None |
| 3 (Comp.) | TAC | 105 | 120 | 45 | 110/24 | Difficult | None | None |
| 4 (Comp.) | PET | 80 | 80 | 60 | None | Difficult | Present | Caused |
| 5 (Comp.) | PET | 90 | 80 | 55 | None | Impossible | Present | Caused |
| 6 (Comp.) | PET | 105 | 80 | 45 | None | Difficult | Present | Caused |
| 7 (Inv.) | PET | 80 | 80 | 60 | 75/24 | Easy | None | None |
| 8 (Inv.) | PET | 90 | 80 | 55 | 75/24 | Easy | None | None |
| 9 (Inv.) | PET | 105 | 80 | 45 | 75/24 | Easy | None | None |
| 10 (Comp.) | PEN | 75 | 119 | 62 | None | Difficult | None | Caused |
| 11 (Comp.) | PEN | 85 | 119 | 57 | None | Difficult | None | Caused |
| 12 (Comp.) | PEN | 95 | 119 | 53 | None | Difficult | None | Caused |
| 13 (Comp.) | PEN | 105 | 119 | 45 | None | Difficult | None | Caused |
| 14 (Inv.) | PEN | 75 | 119 | 62 | 110/24 | Easy | None | None |
| 15 (Inv.) | PEN | 85 | 119 | 57 | 110/24 | Easy | None | None |
| 16 (Inv.) | PEN | 95 | 119 | 53 | 110/24 | Easy | None | None |
| 17 (Inv.) | PEN | 105 | 119 | 45 | 110/24 | Easy | None | None |
| 18 (Comp.) | PEN | 95 | 119 | 53 | 35/240 | Difficult | None | Caused |
| 19 (Comp.) | PEN | 105 | 119 | 45 | 35/240 | Difficult | None | Caused |

Comparative Sample Nos. 1 to 3, in which the polyester support of the present invention is ont used and conventional TAC is used, the decrease in the film thickness caused difficulties with the operation of a tongue end pulling out regardless of the presence of a heat treatment. Using the polyester supports of the present invention, Comparative Sample Nos. 4 to 6 and 10 to 13 were not subjected to heat treatment and not only generated heel folding but also had a difficulty on the tongue end pulling out operation and generated a developing unevenness. Further, Comparative Sample Nos. 18 to 19 falling out of the heat treatment temperature range of the present invention had the difficulty on the tongue end pulling out operation and generated the heel folding. On the other hand, in Sample Nos. 7 to 9 and 14 to 17 comprising the polyester supports of the present invention which were subjected to the heat treatment of the present invention and had the thickness falling within the range of the present invention, a lot of the 35 mm film frames could be stored in a cartridge, the tongue end pulling out operation was good, and the developing unevenness and the heel folding were not generated.

Though it was not shown in Table 9, decreasing the thickness of the support to less than 50 mm even in PET and PEN as the kind of the support could not provide a bending elasticity which could tolerate a shrinking stress in a light-sensitive layer to generate a conduit-form curl and cause a heel folding and a scratch at a development processing step.

Further, poly(oxyisophthaloxy-2,6-dimethyl-l,4 -Phenyleneisopropylidene-3,5-dimethyl-4,4-phenylene) having Tg of 224° C. as a polymer having a glass transition temperature Tg exceeding 200° C. could not provide a transparent support and could not be applied to a lightsensitive material.

Further, all of the light-sensitive materials prepared by using water in place of a conductive fine particle dispersing solution in a back layer gave the generation of a static mark. It is inevitable for increasing the product value of the light-sensitive material in the present invention to provide a conductive layer.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising at least one silver halide emulsion layer on a support and wound in a roll form, wherein the support is a biaxially oriented polyester containing at least 70% by mole of naphthalenedicarboxylic acid and ester thereof as a dicarboxylic acid component, and having a loss elastic modulus of 0.01 to 0.1, a Young's modulus of 530 to 670 kg/mm$^2$, a breaking elongation of 60% to 200%, a crystallinity of 0.3 to 0.5, and a ratio of refraction indexes of film width to film thickness of 1.10 to 1.22.

2. The silver halide photographic materials as in claim 1, wherein the support has a glass transition temperature detected on a thermogram of a differential thermal analyzer of from 90° C. to 200° C.

3. The silver halide photographic material as in claim 1, wherein the support has a birefringence of −0.3 to −0.1, a thickness of 60 to 122 μm, a Young's modulus of 550 to 650 kg/mm$^2$ and a breaking elongation of 80% to 150%.

4. The silver halide photographic material as in claim 1, wherein the support is polyethylene naphthalate.

5. The silver halide photographic material as in claim 1, wherein the support is subjected to a heat treatment having an endothermic amount of from 100 to 1,000 mcal/g at a Tg when the support is measured with a differential thermal analyzer while the temperature is being raised from ≦Tg.

6. The silver halide photographic material as in claim 5, wherein the heat treatment for the support is carried out at a temperature of 40° C. to Tg for 0.1 to 1,500 hours.

7. The silver halide photographic material as in claim 6, wherein the heat treatment is carried out at a temperature of 50° C. to (Tg+130° C.) after the support is wound.

8. The silver halide photographic material as in claim 6, wherein the heat treatment is carried out for 5 to 150 hours.

9. The silver halide photographic material as in claim 5, wherein the heat treatment for the support is carried out at an average cooling speed of −20° to −0.01° C./minute at a temperature of Tg to (Tg-40° C.).

10. The silver halide photographic material as in claim 9, wherein the heat treatment is carried out at a temperature of Tg to (Tg+130° C.) after the support is wound.

11. The silver halide photographic material as in claim 5, wherein a preheat treatment is carried out at a temperature of Tg to (Tg+130° C.) prior to the heat treatment.

12. The silver halide photographic material as in claim 5, wherein the heat treatment is carried out during a heat fixing process through a rolling process in a film forming process.

13. The silver halide photographic material as in claim 5, wherein the heat treatment is carried out during transportation of the support.

14. The silver halide photographic material as in claim 5, wherein the heat treatment is carried out after a water content of the support is conditioned to 0.2% to 5%.

15. The silver halide photographic material as in claim 1, wherein the material is wound on a spool with a major diameter of 5 to 11 mm, and wherein the support has a thickness of 60 to 122 μm.

16. The silver halide photographic material as in claim 1, wherein the material is stored in a cartridge for a 35 mm camera as a 35 mm roll-form film.

17. The silver halide photographic material as in claim 1, wherein the material has at least one layer selected from the group consisting of a layer comprising a conductive oxide, a layer comprising a sliding agent and a layer comprising a matting agent.

18. The silver halide photographic material as in claim 1, wherein the material has at least one perforation.

19. The silver halide photographic material as in claim 1, wherein the dicarboxylic acid is selected from the group consisting of 2,6-naphthalenedicarboxylic acid, 1,5-naphthalenedicarboxylic acid, 1,4-naphthalenedicarboxylic acid and, 2,7-naphthalenedicarboxylic acid.

* * * * *